US005302995A

United States Patent [19]

Hayashi

[11] Patent Number: 5,302,995

[45] Date of Patent: Apr. 12, 1994

[54] PHOTOGRAPHIC DEVELOPING APPARATUS

[75] Inventor: Hiroshi Hayashi, Kanagawa, Japan

[73] Assignee: Fuji Photo Film Co., Ltd., Kanagawa, Japan

[21] Appl. No.: 932,545

[22] Filed: Aug. 20, 1992

[30] Foreign Application Priority Data

Aug. 22, 1991 [JP] Japan ..... 3-233780
Jun. 12, 1992 [JP] Japan ..... 4-177765

[51] Int. Cl.[5] ..... G03D 3/08; G03D 3/02
[52] U.S. Cl. ..... 354/323; 354/324
[58] Field of Search ..... 354/323, 324, 319-322; 134/64 P, 64 R, 122 P, 122 R

[56] References Cited

U.S. PATENT DOCUMENTS 4,451,132 5/1984 Kishimoto ..... 354/324
5,019,850 5/1991 Ishikawa et al. ..... 354/324 X
5,040,013 8/1991 Kurokawa et al. .
5,109,246 4/1992 Yamamoto et al. ..... 354/318

FOREIGN PATENT DOCUMENTS 0355034 2/1990 European Pat. Off. ..... 354/324

*Primary Examiner*—D. Ruthledge

*Attorney, Agent, or Firm*—Sughrue, Mion, Zinn, Macpeak & Seas

[57] ABSTRACT

A wet photographic processing apparatus adapted for processing an imagewise exposed silver halide photographic material compsiring a support having thereon at least one light-sensitive silver halide emulsion layer, said processing comprising at least developing step followed by at least one of a washing step and a stabilizing step, said apparatus comprising: (i) a developing bath; (ii) at least one set of a plurality of washing baths in cascade connection to form countercurrent and/or a plurality of stabilizing baths in cascade connection to form countercurrent; (iii) means for filtering at least a portion of a washing and/or stabilizing solution drawn from a upstream bath among said plurality of baths, said filtering means including a reverse osmotic membrane apparatus filtering said washing and/or stabilizing solution to produce a filtrate; (iv) means for introducing the filtrate from said reverse osmotic membrane apparatus into a downstream bath among said plurality of baths; and (v) means, provided in said pipe, for shutting-off fluid flow between said upstream bath and said reverse osmotic membrane apparatus. The present apparatus prevents loss of processing solution and contamination of the washing baths upon suspension of operation of the processing apparatus.

19 Claims, 3 Drawing Sheets

FIG. 2
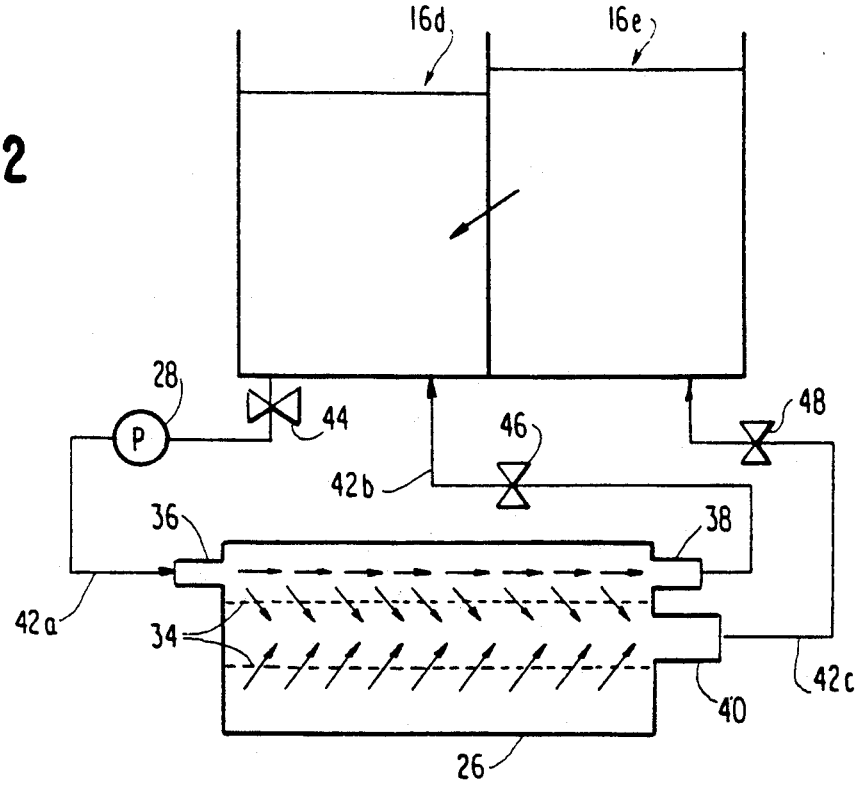
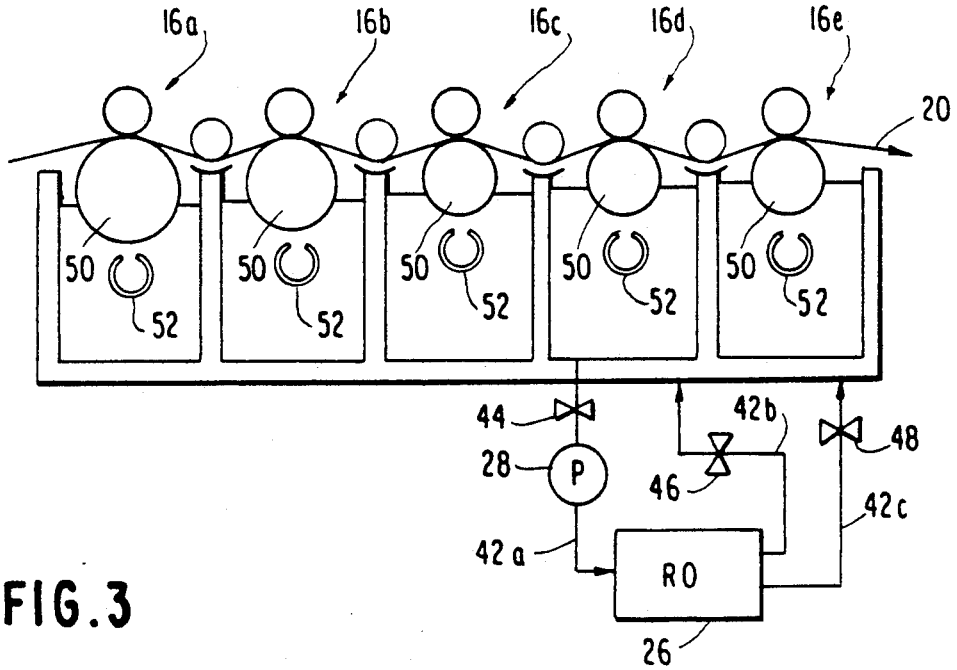
FIG. 3

PHOTOGRAPHIC DEVELOPING APPARATUS

FIELD OF THE INVENTION

The present invention relates to a processing apparatus for developing silver halide photographic material. More particularly, the present invention relates to a processing apparatus for developing silver halide photographic material which enables a total development processing at an ultrahigh speed.

BACKGROUND OF THE INVENTION

In photographic processing of color photographic light-sensitive materials, there recently has been a demand to shorten the processing time to thereby also shorten delivery time and lighten laboratory working. The time required for each processing step can generally be reduced by raising the processing temperature or increasing the replenishment rate. In addition, intensification of agitation or the addition of various accelerators has often been proposed.

In particular, a method comprising processing a color photographic light-sensitive material containing a high silver chloride content emulsion having a high silver chloride content as the light-sensitive silver halide emulsion in place of a silver bromide emulsion or a silver iodide emulsion has heretofore been proposed for expediting color development and/or reducing the replenishment rate, as disclosed, e.g., in International Patent Application Disclosure WO87-04534 corresponding to U.S. Pat. No. 4,892,804 and EP 258288B.

Thus, the use of such a high silver chloride content emulsion or formulation of the developer reduces the development time in a conventional silver bromochloride emulsion system from 210 seconds (e.g., color processing CP-20 of Fiji Photo Film Co., Ltd.) to 45 seconds (e.g., total processing time of 4 minutes, such as color processing CP-40FAS of Fuji Photo Film Co., Ltd.). However, this development time can not be said to be at a satisfactory level as compared with other color processing systems (e.g., electrostatic transfer system, heat transfer system, ink jet system).

Therefore, it has been desired to develop a technique for rapid processing of a silver halide color photographic material which provides a remarkable reduction in total processing time by carrying out color development within 20 seconds, using a system which provides high image quality color prints at low cost.

As an approach for reducing the total processing time, a method which comprises developing a high silver chloride content emulsion with a color developer substantially free of benzyl alcohol to reduce the color development time to 25 seconds or less, and to reduce the sum of the color development time and the time required for blix and rinse and/or stabilization to 2 minutes or less is disclosed in JP-A-1-196044.

However, the above described approach used to reduce both the development time and expedite the entire processing, disadvantageously results in staining of the white background. It is considered that the reduction of development time increases the residual amount of coloring materials (e.g., dyes) in the light-sensitive material. Furthermore, reduction of the time alloted for the subsequent processing steps results in insufficient removal (e.g., washing away) of such coloring materials, to thereby result in staining of the white background. This tendency becomes more pronounced when the recent requirement for low replenishment rate is concurrently employed.

On the other hand, as another approach for inhibiting stain, a method which comprises treating the processing solution in the washing (with water) and/or stabilizing step by a reverse osmosis treatment is known as disclosed in JP-A-60-241053 and JP-A-62-254151. Furthermore, JP-A-3-214155 (corresponding to EP 438156B) discloses a method which comprises treating washing water and/or stabilizing solution in a rapid processing system using a reverse osmotic membrane. In these methods, undesired components (particularly fixing and blix components) can be removed from the washing water and/or stabilizing solution by osmosis filtration of these processing solutions, thereby possibly reducing adverse effects on the light-sensitive material.

The apparatus disclosed in JP-A-3-214155 is basically the same as an apparatus generally used for production pure water using a reverse osmotic membrane. The apparatus is the same as that shown in FIG. 2, except that valves 44, 46 and 48 are not provided. The reverse osmotic membrane (34) is equipped in a cylindrical form. Water in the contaminated processing solution permeates into the cylinder from outside the cylinder leaving concentrated water at the outside, and the permiating water flows out from the inside of the cylinder.

It was found that when only the above described reverse osmosis treatment is applied to the method for reduction of the washing and/or stabilizing time, particularly the time required for the entire sequence of rapid processing steps including color development and drying, sufficient photographic properties cannot be obtained. Consequently, it is difficult to sufficiently inhibit stain using reverse osmosis treatment alone.

Furthermore, even the approach disclosed in the above cited JP-A-3-214155 does not sufficiently accomodate expedition of the blix step or efficiency of removal by the osmotic membrane, leaving much to be desired in the reduction of the time required for the entire sequence of processing steps. For example, it was found that operation of processing machine equipped for reverse osmosis for a prolonged period of time, results in an undesired overflow of washing water or causing insufficient washing of the photographic material once the processing is suspended. The present inventors' study showed that this phenomenon can be explained by the following mechanism. After operation of the processing machine is suspended, pressure is no longer applied to the reverse osmotic membrane, causing osmosis at the osmotic membrane. In some detail, the processing solution (permeating water) inside the osmotic membrane cylinder migrates to the outside of the osmotic membrane cylinder, causing the contaminated water and the concentrated water of the contaminated water outside the reverse osmotic membrane cylinder to flow backward to the washing bath connected thereto through a pipe. Then, the amount of the washing water in the washing bath exceeds the capacity of the washing bath, causing an overflow. Since the washing bath is designed in a counterflow system, the washing water repeatedly overflows towards the prebath to reach the forefront bath from which the washing water eventually overflows.

Even if overflow occurs while operation of the apparatus is suspended to thereby maintain the liquid level, resumed operation of the apparatus causes the processing solution such as washing water to again pass into the reverse osmotic membrane apparatus to thereby lower the liquid level in the washing bath from which the contaminated water is introduced into the reverse osmotic membrane apparatus. The reduced amount of the washing water depends on the time during which the operation of the apparatus is suspended or the area of the reverse osmotic membrane. In the case where a 1.1 $m^2$ DRA-80 membrane (Dicel Kagaku Kogyo K.K; polysulfon composite membrane) is used, the overflow of washing water was found to be 400 ml to 500 ml. When the operation of the processing machine is resumed, the washing water is first pumped into the reverse osmotic membrane apparatus until the inside of the osmotic membrane cylinder is filled therewith. Therefore, the bath from which the contaminated water has been taken out is deficient in washing water by 400 ml to 500 ml. Thus, if the replenishment rate is 60 $ml/m^2$, 8 $m^2$ of the light-sensitive material needs to be processed (8.9 cm wide × 90 m long light-sensitive material) so that the specified amount of washing water is reached. During this period, the light-sensitive material is not sufficiently washed in this bath (reduction in the effective washing time), thereby causing increased occurrence of stain. Furthermore, the unexpected overflow during suspension of the operation of the apparatus is disadvantageous and contrary to reduced replenishment rate and waste liquid in small-sized processing baths. Moreover, the replenishment of washing water in a specified amount upon the resumption of the operation of the apparatus (to make up for loss in washing water) causes undesirable problems such as complicated working and installation of water pipe.

Thus, as the washing and/or stabilizing step is expedited, the fluctuation in the processing time due to the fluctuation in the liquid level cannot be neglected. In particular, the fluctuation in the processing time causes an increased occurrence of stain. Furthermore, since the intended washing water or stabilizing solution cannot be used for processing, the system is susceptible to an increased occurrence of stain.

It has been proposed to solve this problem by providing an air intake in the liquid circulation path so that the bath and the piping are separated from each other. However, even if this approach is employed, the reverse osmotic membrane still acts as a pump such that the problem of fluctuation in liquid level remains.

SUMMARY OF THE INVENTION

It is therefore an object of the present invention to provide a processing apparatus for developing silver halide photographic material which provides satisfactory photographic properties (particularly stain inhibition), even if ultrahigh rapid processing is effected by reducing the washing and/or stabilizing time and by reducing the replenishment rate of the washing water and/or stabilizing solution.

The above described object of the present invention will become more apparent from the following detailed description and Examples.

The above described object of the present invention is accomplished with the following processing apparatus:

A wet photographic processing apparatus adapted for development processing an imagewide exposed silver halide photographic material comprising a support having thereon at least one light-sensitive silver halide emulsion layer, said processing comprising at least a developing step followed by at least one of a washing step and a stabilizing step, said apparatus comprising a developing bath; at least one set of a plurality of washing baths in cascade connection to form countercurrent and/or a plurality of stabilizing baths in cascade connection to form countercurrent; means for filtering at least a portion of a washing and/or stabilizing solution drawn from a upstream bath (with respect to the conveying direction of the photographic material) among said plurality of baths, said filtering means including a reverse osmotic membrane apparauts and a pipe connecting the upstream bath and the reverse osmotic membrane apparatus, said reverse osmotic membrane apparatus filtering said washing or stabilizing solution to produce a filtrate; means for introducing the filtrate from said reverse osmotic membrane apparatus into a downstream bath among said plurality of baths; and means, provided in said pipe, for shutting-off fluid flow between said upstream bath and said reverse osmotic membrane apparatus.

Preferred embodiments of the present invention are as follows:

A processing apparatus as defined above, wherein the capacity of each of the washing baths and/or stabilizing baths is 10 l or less; and a processing apparatus as defined above, further comprising means for countercurrent replenishment of the washing baths and/or stabilizing baths in an amount of 150 ml or less per $m^2$ of photographic material processed, and means for controlling the ratio of the filtrate rate to replenishment rate per unit time to from 5 to 55.

The passage shut-off means includes, for example, a valve, shutter or the like. As the operation of the apparatus is suspended, the passage shut-off means can be activated to close the passage between the reverse osmotic membrane apparatus and the processing bath. In this case, the passage can be closed concurrent with suspension of the temperature control of the processing bath, or in accordance with information regarding the suspension of temperature control of the processing bath. Alternatively, a check valve can be provided in the piping so that the processing solution can flow only in a single predetermined direction and under a predetermined pressure. With this arrangement, substantially the same effect as opening/closing of the passage is obtained without providing an operation control system.

The above described passage shut-off means in the piping connecting the reverse osmotic membrane apparatus and the washing or stabilizing bath is used to prevent concentrated water (i.e., contaminated water rejected by the osmotic membrane) and the filtrate inside the reverse osmotic membrane apparatus from flowing into the washing or stabilizing bath. Accordingly, when operation of the apparatus is suspended, none of the processing baths overflows to thereby, maintain the desired liquid level therein.

When operation of the apparatus is resumed, the reverse osmotic apparatus is already filled with processing solution. Therefore, it is not necessary to rapidly supply the processing solution from the bath to the reverse osmotic membrane apparatus in a large amount. Thus, the washing and/or stabilizing step can be properly carried out while maintaining the specified liquid level.

The reverse osmotic membrane is important for attaining ultrarapid processing and reduced replenishment rate. However, when the processing solution flows backward through the reverse osmotic membrane when the operation is suspended, the washing water becomes contaminated as described above. In particular, if the washing bath is small, the backward flow of the processing solution causes overflow of the processing solution, to thereby greatly hinder processing the following day. However, when a passage shut-off means is provided in the piping connecting the reverse osmotic membrane apparatus and the processign bath in accordance with the present invention, the adverse effect due to backward flow of the processing solution in the reverse osmotic membrane apparatus is prevented.

BRIEF DESCRIPTION OF THE DRAWING

By way of example and to augment the description herein, refernce is made to the accoompanying drawings in which:

FIG. 2 is a diagrammatic view illustrating the connection of a reverse osmotic membrane apparatus;

FIG. 3 is diagrammatic view of a modified embodiment of washing bath;

DETAILED DESCRIPTION OF THE INVENTION

Figure 1:
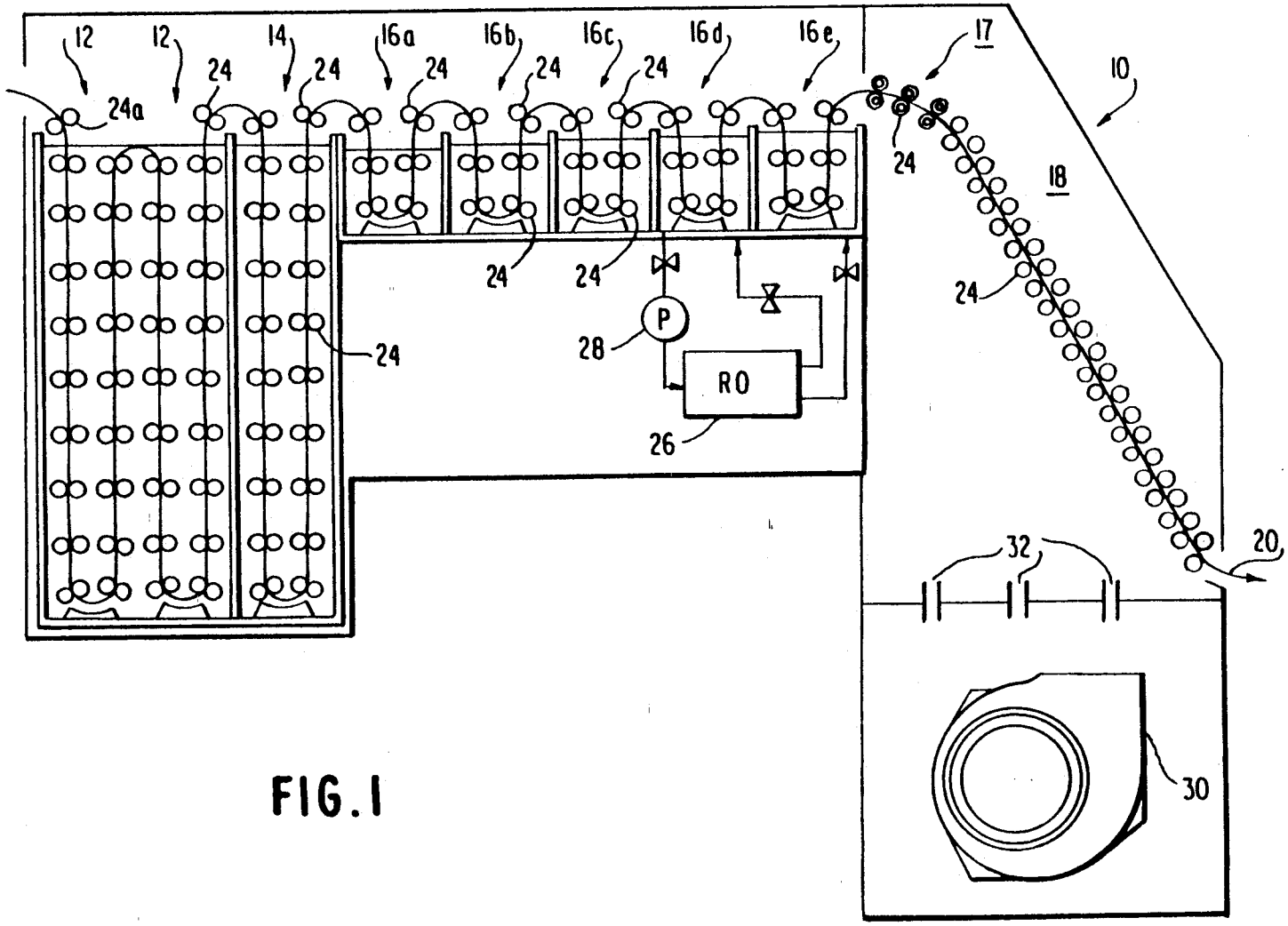
FIG. 1 is a chematic diagrammatic view of an embodiment of the photographic processing apparatus of the present invention.

The apparatus of the present invention is described in further detail below. In the following description, the upstream bath directly connected to the reverse osmotic membrane apparatus for supplying the processing solution (washing water or stabilizing solution unless otherwise specified) into the reverse osmotic membrane apparatus is designated a contaminated water intake bath. The downstream bath into which the filtrate of the reverse osmotic membrane flows is designated a filtrate inlet bath. The capacity of the contaminated water intake bath is measured from the bottom to the opening for overflow. Furthermore, the sum of the capacity of the piping from the contaminated water intake bath to the reverse osmotic membrane apparatus, the capacity of the pump used for pressurizing the reverse osmotic membrane apparatus, the capacity of the reverse osmotic membrane apparatus itself, the capacity of the piping from the reverse osmotic membrane apparatus to the filtrate inlet at the filtrate inlet bath, and the capacity of the filtrate inlet bath (as the bath following the contaminated water intake bath) from the filtrate inlet to the opening for overflow is defined as the total capacity of the reverse osmotic membrane apparatus.

The effects of the apparatus of the present invention are described below by reference to problems of the prior art solved by employing the means for shutting off fluid flow of the present invention. The problems encountered the means of the present invention is not used include reduction of the processing solution in tank during suspension of operation at night, and the loss of time (i.e., start-up time) and light-sensitive material until stabilization upon resumption of operation of the apparatus(i.e., start-up time). The apparatus of the present invention remarkably improves a conventional apparatus adversely effected by these two problems.

From the standpoint of construction of the apparatus, the first problem of reduction of the processing solution volume is encountered in two typical cases. In the first case, the filtrate inlet for the filtrate inlet bath is present in the processing solution (i.e., the opening is present at the position lower the sufface of water in the filtrate inlet bath) and the reverse osmotic membrane apparatus is installed in the lower part of the filtrate inlet bath. The osmotic upon suspension of operation causes the processing solution to overflow by the internal capacity of the reverse osmotic membrane apparatus per se by osmosis, and also causes all of the processing solution present between the filtrate inlet and the opening for overflow in the filtrate inlet bath to flow out, to thereby result in a considerable loss of processing solution. The construction in which the reverse osmotic membrane apparatus is installed under the washing bath is most preferred because the filtrate is not taken in through the air, to thereby prevent air from being entrained therein, the circulation of the processing solution in the washing bath or stabilizing bath can be accelerated, and the lower part of the washing bath or stabilizing bath normally has enough space for the reverse osmotic membrane apparatus for compactness. In this construction, the effects of the present invention are pronounced.

In a second construction, the filtrate inlet is present outside the filtrate inlet bath (the inlet is present at the position higher than the surface of the water in the bath). In this construction, the processing solution flows out from the developing apparatus in an amount corresponding to the internal capacity of the reverse osmotic membrane apparatus per se.

The above described two constructions adversely affect the photographic properties, i.e., reduction in the washing time due to reduction in the amount of the washing water. In either construction, in order to obtain excellent photographic properties (e.g., inhibition of uneven processing possibly due to poor liquid circulation such as liquid pulsation and entainment of bubbles), the ratio of the internal capacity of the contaminated water intake bath to the total internal capacity of the reverse osmotic membrane apparatus is preferably in the range of 0.1 to 10, more preferably 0.2 to 5. In the apparatus construction associated with this arrangement, the number of each set of washing baths and stabilizing baths is preferably in the range of 2 to 6, more preferably 2 to 5. Furthermore, the present invention is suitable for rapid processing which has no enough time for the washing and/or stabilizing step. The time required for the washing and/or stabilizing step is preferably in the range of 5 seconds to 60 seconds, more preferably 10 seconds to 45 seconds.

The second problem encountered when the means for shutting off fluid flow of the present invention is not used is the deterioration of photographic properties which continues until the entire amount of processing solution lost during suspension of operation is replenished upon resumption of the operation. As discussed above, the processing solution which returns to the contaminated water intake bath by osmosis upon suspension of the operation of the apparatus flows into the upstream washing or stabilizing bath (due to use of a countercurrent system), and then eventually overflows outside the developing apparatus. When operation of the apparatus is resumed, the processing solution is replenished by adding a replenisher. The time required until the washing or stabilizing bath recovers to the normal state (normal running state) is determined by the relationship between the amount of processing solution lost during suspension of operation and the replenishment rate. Furthermore, the processing bath(s) between the upstream washing or stabilizing bath and the bath directly prior to the contaminated water intake bath are not replenished by a processing solution having a low degree of contamination until the contaminated water intake bath is filled (until the processing solution overflows to the immediately preceding bath). Consequently, the amount of the light-sensitive material processed during this period is an important factor until the performance of the processing apparatus returns to the normal running state.

As discussed above, the total internal capacity of the reverse osmotic membrane apparatus, the replenishment rate, the amount of light-sensitive material processed per unit time (e.g., conveying speed of light-sensitive material, width of light-sensitive material), the capacity from the first upstream washing or stabilizing bath to the bath immediately prior to the contaminated water intake bath, etc. are important to further attain the effects of the present invention. Specifically, the amount of light-sensitive material processed per unit time is preferably in the range of 2 $m^2$/hr. to 50 $m^2$/hr., more preferably 4.8 $m^2$/hr. to 40 $m^2$/hr. The ratio of the total internal capacity of the reverse osmotic membrane apparatus (ml) to the replenishment rate (ml/$m^2$) is preferably in the range of 3 to 500, more preferably 10 to 200. The effects of the present invention is pronounced when the capacity of at least one of, (preferably each of all) of the bath from the first upstream washing or stabilizing bath to the bath directly prior to (prior to and adjacent in the processing sequence) the contaminated processing solution intake bath is preferably in the range of 0.1 to 10 l, more preferably 0.2 to 4 l. The reason for this is that when the capacity is small, supplying of more clean liquid by overflowing is very effective. The capacity of each of the contaminated processing solution intake bath and the bath to which the filtrate is introduced is also preferably in the range of 0.1 to 10 l, more preferably 0.2 to 4 l because the effects of the present invention is more pronounced in a smaller bath. The effect of the present invention are also pronounced when processing at a low replenishment rate. The replenishment rate is preferably in the range of 30 to 150 ml/$m^2$, more preferably 35 to 90 ml/$m^2$, particularly 45 to 60 ml/$m^2$.

The present invention is characterized by the use of a reverse osmotic membrane in the washing or stabilizing step. The material of the reverse osmotic membrane for use in the present invention is not particluarly limited. It is preferred that the pore size of membrane is from about 0.1 to 2 A. Examples of the reverse osmotic membrane material include cellulose acetate, crosslinked polyamide, polyether, polysulfone, polyacrylic acid and polyvinylene carbonate. Particularly preferred among these reverse osmotic membrane materials are crosslinked polyamide composite films and polysulfone composite films, which films tend to better retain their permeability over time. It is preferred that the membrane has filtration ability to remove at least 90% of the contaminant in the processing aqueous solution introduced into the reverse osmosis membrane apparatus.

For minimizing the initial cost, running cost and size of the apparatus and the prevention of noise of the pump, a low pressure reverse osmotic membrane which operates at a liquid pumping pressure of as low as 2 to 15 kg/$cm^2$ is preferably used. Furthermore, the membrane is preferably in a spiral form obtained by winding a plain membrane, because this spiral form retain its permeability even after prolonged use. Specific examples of such a low pressure reverse osmotic membrane (spiral form) include SU-200S, SU-210S and SU-220S (crosslinked polyamide composite films) produced by Toray Industries Inc., and DRA-40, DRA-80 and DRA-86 (polyfulfone composite films) produced by Dicel Kagaku Kogyo K.K.

The liquid pumping pressure at which these membrane are used is generally in the above specified range. From the standpoint of the performance of the apparatus, the liquid pumping pressure is preferably in the range of from 2 to 10 kg/$cm^2$, particularly from 3 to 7 kg/$cm^2$.

The pump for use in the present invention is appropriately selected from commercially available gear pumps and rotary vane type pumps depending on the discharge pressure and the size thereof. In particular, a magnet gear pump (maximum discharge pressure: 4 kg/$cm^2$) produced by Iwaki Corporation, a magnet gear pump B7045 (maximum discharge pressure: 5 kg/$cm^2$), D7045 (maximum discharge pressure: 8 kg/$cm^2$) and D7349 (maximum discharge pressure: 9 kg/$cm^2$) produced by Tuthill Corporation, and a rotary vane type self-supply pump "Procon" 1500 series (maximum discharge pressure: 9 kg/$cm^2$) produced by Nihon G Rotor K.K. can be used.

The check valve for use in the present invention is appropriately selected from commercially available check valves Specific examples of such check valves include 980 series (operating pressure: 6 seconds (water-gauge pressure)) produced by Mase Corporation, 4CP series (operating pressure: 8 seconds (water-gauge pressure)) produced by Nupro Corporation, and a lift type check valve (operating pressure: 10 seconds (water-gauge pressure)) produced by Whitey Corporation.

The internal capacity of the reverse osmotic membrane apparatus itself is important for best achieving the effects of the present invention and is preferably in the range of from 300 ml to 10 l, more preferably 600 ml to 5 l. The area of the reverse osmotic membrane is preferably in the range of from 0.3 $m^2$ to 10 $m^2$, more preferably from 1.0 $m^2$ to 5 $m^2$.

The required amount of permeated water is determined by the quality of the filtrated water (removing properties of the reverse osmotic membrane), the amount of light-sensitive material to be processed by the automatic processing machine, the amount of the processing solution brought over from a preceding bath by the light-sensitive material, and the replenishment rate to the washing or stabilizing baths. The rate of the permeated water is generally in the range of from 1 to 100 times (by volume) the replenishment rate to the washing or stabilizig baths. It is preferably in the range of 5 to 55 times, particularly 10 to 30 times the replenishment rate when the apparatus operates at a low replenishment rate. This arrangement is easily accomplished by adjusting the replenishment rate of the processing solution or the operating conditions of the reverse osmotic apparatus.

The reverse osmotic membrane is preferably mounted in a pressure-resistant vessel made of metal or plastic, and then incorporated into the apparatus of the present invention. Useful materials for the pressure-resistant vessel include glass-fiber reinforced plastic in light of corrosion resistance and pressure resistance. In the present invention, the fresh water supplied to the washing bath and/or stabilizing bath (as a replenisher) may be tap water, well water or the like commonly used in the washing step. In order to inhibit the proliferation of bacteria in the bath into which the fresh water is supplied and to prolong the life of the reverse osmotic membrane, water having a calcium and magnesium content each reduced to 3 mg/l or less is preferably used. In particular, water which has been deionized through an ion exchange resin or by distillation is preferably used.

The photographic processing apparatus of the present invention may comprise a development step (black-and-white development, color development) and a washing and/or stabilizing step as a final step, as well as a desilvering step (e.g., blix, bleach, fixing), an adjusting step, a reversal step and an intermediate washing step.

The apparatus of the present invention may comprise either a washing step or stabilizing step, or may comprise both a washing step and stabilizing step in this order. Where both a washing step and a stabilizing stepare employed, at least one of the two steps is a multi-stage system comprising at least two baths. In this multi-stage system, the replenisher is supplied into the final bath from which the overflow is introduced into its preceding bath. Thus, a multi-stage countercurrent system is generally employed. The overflow is eventually discharged from the developing apparatus through the first upstream bath (i.e., washing or stabilizing bath nearest to the developing bath).

In the apparatus of the present invention, the reverse osmotic membrane apparatus may be installed in either the washing step or the stabilizing step. The processing solution (washing water or stabilizing solution) is taken from the upstream bath of the washing step or stabilizing step and then introduced into the reverse osmotic membrane apparatus as contaminated water. The permeated water which has been filtered out through the reverse osmotic membrane apparatus is then introduced into the downstream bath in the washing step or stabilizing step while the concentrated water is preferably introduced into the bath preceding the downstream bath (preferably the bath adjacent to the downstream bath).

In the present invention, the contaminated water intake bath and the filtrate inlet bath are different from each other and may be contiguous or may have another bath interposed therebetween.

It is preferable that the reverse osmotic membrane apparatus is installed between the two last baths among the washing baths and/or among the stabilizing baths.

The reverse osmotic membrane apparatus may be connected to either the washing step or the stabilizing step, or both steps may each has the apparatus.

In the apparatus of the present invention, the passage shut-off means is preferably installed between the contaminated water intake bath and the reverse osmotic membrane apparatus to best achieve the effect of the present invention. In this arrangement, the order of the liquid conveying means such as a pump and the passage shut-off means provided between the contaminated water intake bath and the reverse osmotic membrane apparatus is not particularly restricted.

The passage shut-off means may also be provided at the connecting pipe for introducing the concentrated solution to a bath and/or at the connecting pipe for introducing permeated water into a bath.

The light-sensitive material for processing in accordance with the present invention is generally a light-sensitive material which can undergo wet processing. Examples of such a light-sensitive material include black-and-white light-sensitive materials for printing, medical and common use, and color photographic light-sensitive materials such as color negative films, color reversal films and color paper. By making best use of the rapid porcessing capability of the present apparatus, color prints can be processed. Thus, the present apparatus can be applied to the processing of intelligent color hard copy which requires processing which is further expedited.

In an embodiment of the present invention for application to the processing of intelligent color hard copy, high density light from a laser (e.g., semiconductor laser), light-emitting diode or the like can be used to effect scanning exposure.

The silver halide for use in the light-sensitive material in accordance with the present invention includes silver chloride, silver bromide, silver bromochloro(iodide), silver bromoiodide or the like. For rapid processing, a silver bromochloride or silver chloride emulsion substantially free of silver iodide having a silver chloride content of 90 mol % or more; more preferably 95 mol % or more, particularly 98 mol % or more is preferably used.

A hydrophilic colloidal layer of the light-sensitive material for processing in accordance with the present invention preferably comprises a dye which is decolored upon processing (particularly an oxonol dye) as disclosed in European Patent No. 0,337,490A2, pp. 27–76, in an amount to provide an optical reflective density of the light-sensitive material at 680 nm of 0.70 or more. Titanium oxide surface treated with a divalent to tetra valent alcohol (e.g., trimethylolethane) may be added to the water-resistant resin layer of the support in an amount of 12% by weight or more (more preferably 14% by weight or more) for improving the sharpness of image or the like.

The light-sensitive material for processing in accordance with the present invention preferably comprises a dye image preservability improving compound as disclosed in European Patent 0,277,589A2 in combination with couplers, particularly pyrazoloazole couplers.

In particular, a compound which chemically bonds to aromatic amine developing agent remaining after color development to produce a chemically inert and substantially colorless compound and/or a compound which chemically bonds to the oxidation product of an aromatic amine color developing agent remaining after color development to produce a chemically inert and substantially colorless compound are preferably used alone or in combination. These compounds inhibit the occurrence of stain or other side effects after processing caused by the formation of developed dyes by the reaction of residual color developing agent or its oxidation product in the film with a coupler during storage.

The light-sensitive material for processing in accordance with the present invention preferably comprises a mildew-proofing agent as disclosed in JP-A-63-271247 to prevent the propagation of various mildew and bacteria in the hydrophilic colloidal layer and resulting deterioration of the image.

The support to be used in the light-sensitive material includes a white polyester support for display, or a support comprising a white pigment-containing layer on the silver halide emulsion layer side. In order to further improve image sharpness, an antihalation layer is preferably coated on the silver halide emulsion side or opposite side of the support. In order to enable display by means of reflected light or transmitted light, the transmission density of the support is preferably adjusted within a range of from 0.35 to 0.8.

The light-sensitive material for processing in accordance with the present invention may be imagewise exposed to visible light or infrared light. Exposure may be carried out by a low intensity exposure process, or by a high intensity short time exposure process. In the latter case, a laser scanning exposure process with an exposure time of $10^{-4}$ seconds per pixel is preferably used.

The imagewise exposed light-sensitive color photographic material is generally subjected to color development. For rapid processing, the color development is preferably followed by blix (bleach-fix) processing. In particular, if the above noted high silver chloride content emulsion is used, the pH value of the blix solution is preferably in the range of about 7 or less, more preferably about 6.5 or less for accelerating the desilvering effect.

Useful silver halide emulsions and other materials (additives) for incorporation into the light-sensitive material for processing in accordance with the present invention, photographic constituent layers of the light-sensitive material (layer arrangement) and processing methods and processing additives for use in processing the light-sensitive material preferably include those described in the following patents, particularly European Patent 0,355,660A2 (corresponding to Japanese Patent Application No. 1-107011 and to U.S. Pat. No. 5,122,444).

TABLE 1

| Photographic constituent element | JP-A-62-215272 | JP-A-2-33144 | EP0,355,660A2 |
|---|---|---|---|
| Silver halide emulsion | Line 6, upper right column on p. 10–line 5, lower left column on p. 12 & last line 4, lower right column on p. 12–line 17, upper left column on p. 13 | Line 16, upper right column on p. 28–line 11, lower right column on p. 29 & line 2–line 5 on p. 30 | Line 53 on p. 45–line 3 on p. 47 & line 20–line 22 on p. 47 |
| Silver halide solvent | Line 6–line 14, lower left column on p. 12 & last line 3, upper left column on p. 13–last line, lower left column on p. 18 | — | — |
| Chemical sensitizer | Last line 3, lower left column–last line 5, lower right column on p. 12 & line 1, lower right column on p. 18–last line 9, upper right column on p. 22 | Line 12–last line, lower right column on p. 29 | Line 4–line 9 on p. 47 |
| Spectral sensitizer (spectral sensitizing method) | Last line 8, upper right column on p. 22–last line on p. 38 | Line 1–line 13, upper left column on p. 30 | Line 10–line 15 on p. 47 |
| Emulsion stabilizer | Line 1, upper left column on p. 39–last line, upper right column on p. 72 | Line 14, upper left column–line 1, upper right column on p. 30 | Line 16–line 19 on p. 47 |
| Development accelerator | Line 1, lower left column on p. 72–line 3, upper right column on p. 91 | — | — |
| Color coupler (cyan, magenta, yellow couplers) | Line 4, upper right column on p. 91–line 6, upper left column on p. 121 | Line 14, upper right column on p. 3–last line, upper left column on p. 18 & line 6, upper right column on p. 30–line 11, lower right column on p. 35 | Line 15–line 27 on p. 4, line 30 on p. 5–last line on p. 28, line 29–line 31 on p. 45 & line 23 on p. 47–line 50 on p. 63 |
| Color intensifier | Line 7, upper left column on p. 121–line 1, upper right column on p. 125 | — | — |
| Ultraviolet absorbent | Line 2, upper right column on p. 125–last line, lower left column on p. 127 | Line 14, upper right column on p. 37–line 11, upper left column on p. 38 | Line 22–line 31 on p. 65 |
| Discoloration inhibitor (image stabilizer) | Line 1, lower right column on p. 127–line 8, lower left column on p. 137 | Line 12, upper right column on p. 36–line 19, upper left column on p. 37 | Line 30 on p. 4–line 23 on p. 5, line 1 on p. 29–line 25 on p. 45, line 33–line 40 on p. 45 & line 2–line 21 on p. 65 |
| High boiling and/or low boiling organic solvent | Line 9, lower left column on p. 137–last line, upper right column on p. 144 | Line 14, lower right column on p. 35–last line 4, upper left column on p. 36 | Line 1–line 51 on p. 64 |
| Process for | Line 1, lower left column | Line 10, lower right column | Line 51 on p. 63– |

TABLE 1-continued

| Photographic constituent element | JP-A-62-215272 | JP-A-2-33144 | EP0,355,660A2 |
|---|---|---|---|
| dispersion of photographic additives | on p. 144–line 7, upper right column on p. 146 | on p. 27–last line, upper left column on p. 28 & line 12, lower right column on p. 35–line 7, upper right column on p. 36 | line 56 on p. 64 |
| Film hardener | Line 8, upper right column on p. 146–line 4, lower left column on p. 155 | — | — |
| Developing agent precursor | Line 5, lower left column on p. 155–line 2, lower right column on p. 155 | | |
| Development inhibitor-releasing compound | Line 3–line 9, lower right column on p. 155 | — | — |
| Support | Line 19, lower right column on p. 155–line 14, upper left column on p. 156 | Line 18, upper right column on p. 38–line 3, upper left column on p. 39 | Line 29 on p. 66–line 13 on p. 67 |
| Constitution of light-sensitive layers | Line 15, upper left column on p. 156–line 14, lower right column on p. 156 | Line 1–line 15, upper right column on p. 28 | Line 41–line 52 on p. 45 |
| Dye | Line 15, lower right column on p. 156–last line, lower right column on p. 184 | Line 12, upper left column–line 7, upper right column on p. 38 | Line 18–line 22 on p. 66 |
| Color stain inhibitor | Line 1, upper left column on p. 185–line 3, lower right column on p. 188 | Line 8–line 11, upper right column on p. 36 | Line 57 on p. 64–line 1 on p. 65 |
| Gradation adjustor | Line 4–line 8, lower right column on p. 188 | — | — |
| Stain inhibitor | Line 9, lower right column on p. 188–line 10, lower right column on p. 193 | Last line, upper left column–line 13, lower right column on p. 37 | Line 32 on p. 65–line 17 on p. 66 |
| Surface active agent | Line 1, lower left column on p. 201–last line, upper right column on p. 210 | Line 1, upper right column on p. 18–last line, lower right column on p. 24 & last line 10, lower left column–line 9, lower right column on p. 27 | — |
| Fluorine-containing compound (antistatic agent, coating aid, lubricant, adhesion inhibitor) | Line 1, lower left column on p. 210–line 5, lower left column on p. 222 | Line 1, upper left column on p. 25–line 9, lower right column on p. 27 | — |
| Binder (hydrophilic colloid) | Line 6, lower left column on p. 222–last line, upper left column on p. 225 | Line 8–line 18, upper left column on p. 38 | Line 23–line 28 on p. 66 |
| Thickening agent | Line 1, upper right column on p. 225–line 2, upper right column on p. 227 | — | — |
| Antistatic agent | Line 3, upper right column on p. 227–line 1, upper left column on p. 230 | — | — |
| Polymer latex | Line 2, upper left column on p. 230–last line on p. 239 | — | — |
| Matting agent | Line 1, upper left column on p. 240–last line, upper right column on p. 240 | — | — |
| Photographic processing method (processing step, additives, etc.) | Line 7, upper right column on p. 3–line 5, upper right column on p. 10 | Line 4, upper left column on p. 39–last line, upper left column on p. 42 | Line 14 on p. 67–line 28 on p. 69 |

Note)
The portions of specification of JP-A-62-215272 cited herein include the written amendment of March 16, 1987 attached thereto.

Among the above noted color couplers, the short wave type yellow couplers as disclosed in JP-A-63-231451, JP-A-63-123047, JP-A-63-241547, JP-A-1-173499, JP-A-1-213648, and JP-A-1-250944 are preferred.

Preferred cyan couplers include the 3-hydroxypyridine cyan couplers disclosed in European Patent (EP) 0,333,185A2 (particularly those which have been rendered two-equivalent by incorporating a chlorine-releasing group as exemplified in Coupler (42), Coupler (6) and coupler (9)) or the cyclic active methylene cyan couplers disclosed in JP-A-64-32260 (particularly Coupler Examples 3, 8, 34 as exemplified therein) in addition to the diphenylimidazole cyan couplers disclosed in JP-A-2-33144.

In the present invention, the developer may be a color developer or a black-and-white developer.

The color developer for use in the present invention comprises a known aromatic primary amine color developing agent. Preferred examples of the aromatic primary amine color developing agent include p-phenylenediamine derivatives. Specific examples of such p-phenylenediamine derivatives are set forth below, but the present invention should not be construed as being limited thereto.

D-1: N,N-diethyl-p-phenylenediamine
D-2: 4-Amino-N,N-diethyl-3-methylaniline
D-3: 4-Amino-N-(β-hydroxyethyl)-N-methylaniline
D-4: 4-Amino-N-ethyl-N-(β-hydroxyethyl)aniline
D-5: 4-Amino-N-ethyl-N-(β-hydroxyethyl)-3-methylaniline
D-6: 4-Amino-N-ethyl-N-(3-hydroxypropyl)-3-methylaniline
D-7: 4-Amino-N-ethyl-N-(4-hydroxybutyl)-3-methylaniline
D-8: 4-Amino-N-ethyl-N-(β-methanesulfonamidoethyl)-3-methylaniline
D-9: 4-Amino-N,N-diethyl-3-(β-hydroxyethyl)aniline
D-10: 4-Amino-N-ethyl-N-(β-methoxyethyl)-3-methylaniline
D-11: 4-Amino-N-(β-ethoxyethyl)-N-ethyl-3-methylaniline
D-12: 4-Amino-N-(3-carbamoylpropyl)-N-n-propyl-3-methylaniline
D-13: 4-Amino-N-(4-carbamoylbutyl)-N-n-propyl-3-methylaniline
D-14: N-(4-amino-3-methylphenyl)-3-hydroxypyrrolidine
D-15: N-(4-amino-3-methylphenyl)-3-(hydroxymethyl)-pyrrolidine
D-16: N-(4-amino-3-methylphenyl)-3-pyrrolidinecarboxamide Particularly preferred among these p-penylenediamine derivatives are exemplary compounds D-5, D-6, D7, D-8 and D-12. These p-phenylenediamine derivatives may be used in the form of salt such as sulfate, hydrochloride, sulfite, naphthalene disulfonate and p-toluenesulfonate. The addition amount of the aromatic primary amine color developing agent is preferably in the range of about 0.002 mol to 0.2 mol, more preferably from 0.005 mol to 0.15 mol, most preferably from 0.01 to 0.15 mol per l of the color developer.

In the implementation of the present invention, a developer substantially free of benzyl alcohol is preferably used. The term "substantially free of benzyl alcohol" as used herein means "containing benzyl alcohol in an amount of preferably 2 ml/l or less, more preferably 0.5 ml or less, most preferably none."

More preferably, the developer for used in the present invention is substantially free of sulfurous ion. Sulfurous ion serves as a preservative for the developing agent. Sulfurous ion also serves to dissolve silver halide, and reacts with an oxidation product of a developing agent to lower the efficiency of dye formation. Such an effect is considered to be one of the causes of the fluctuation in the photographic properties in continuous processing. The term "substantially free of sulfurous ion" as used herein means "containing sulfurous ion in an amount of preferably $3.0\times10^{-3}$ mol/l or less, most preferably none."

The developer for use in the present invention is most desirably substantially free of sulfurous ion. Furthermore, the developer is most desirably substantially free of hydroxylamine. It is considered that hydroxylamine not only serves as developer preservative, but also exhibits silver development activity and greatly affects the photographic properties when the concentration thereof fluctuates. The term "substantially free of hydroxylamine" as used herein means "containing hydroxylamine in an amount of preferably $5.0\times10^{-3}$ mol/l or less, most preferably none."

More preferably, the developer for used in the present invention comprises an organic preservative instead of the above noted hydroxylamine or sulfurous ion.

The organic preservative is an organic compound which reduces the deterioration rate of an aromatic primary amine color developing agent when incorporated into a processing solution for a color photographic light-sensitive material, i.e., an organic compound which inhibits the oxidation of the color developing agent by air or the like. In particular, hydroxylamine derivatives (excluding hydroxylamine, hereinafter the same), hydroxamic acids, hydrazines, hydrazides, phenols, α-hydroxyketones, α-aminoketones, saccharides, monoamines, diamines, polyamines, tertiary ammonium salts, nitroxy radicals, alcohols, oximes, diamide compounds, and condensed ring amines are effective organic preservatives. Useful compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, and JP-A-52-143020, U.S. Pat. Nos. 3,615,503, and 2,494,903, and JP-B-48-30496.

Other examples of preservatives which can be contained as necessary include various metals as described in JP-A-57-44148 and JP-A-57-53749, salicylic acids as described in JP-A-59-180588, alkanolamines as described JP-A-54-3532, polyethyleneimines as described JP-A-56-94349, and aromatic polyhydroxy compounds as described in U.S. Pat. No. 3,746,544. In particular, alkanolamines such as triethanolamine, dialkylhydroxylamine such as diethylhydroxylamine, hydrazine derivatives or aromatic polyhydroxy compounds are preferably used.

Particularly preferred among these organic preservatives are hydroxylamine derivatives and hydrazine derivatives (e.g., hydrazines, hydrazides). These compounds are further described in JP-A-1-97953, JP-A-1-186939, JP-A-1-186940, and JP-A-1-187557.

The above described hydroxylamine derivative or hydrazine derivative is preferably used in combination with an amine to improve the stability of the color developer and hence the stability of the system during continuous processing.

Examples of the above noted amine include the cyclic amines as described in JP-A-63-239447, the amines described in JP-A-63-128340, and the amines described in JP-A-1-186939 and JP-A-1-187557.

In processing in accordance with the present invention, the color developer preferably contains chloride ion in an amount of from $3.5\times10^{-2}$ to $1.5\times10^{-1}$ mol/l particularly $4\times10^{-2}$ to $1\times10^{-1}$ mol/l. If this value exceeds $1.5\times10^{-1}$, the chloride ion disadvantageously retards development, making it difficult to accomplish the objects of the present invention (i.e., rapid processing and high maximum density). On the contrary, if the chloride ion concentration falls below $3.5\times10^{-2}$ mol/l, fogging is not effectively inhibited.

In processing in accordance with the present invention, the color developer preferably comprises bromide ion in an amount of from $1.0\times10^{-3}$ mol/l or less, more preferably $5.0\times10^{-4}$ mol/l or less. If this value exceeds $1\times10^{-3}$ mol/l, the bromide ion retards development and reduces maximum density and sensitivity.

Chloride ion and bromide ion may be directly added to the developer, or may be eluted from the light-sensitive material into the developer during development.

Examples of chloride ion-supplying substances which can be directly added to the color developer include sodium chloride, potassium chloride, ammonium chloride, lithium chloride, nickel chloride, magnesium chloride, manganese chloride, calcium chloride, and cadmium chloride. Preferred among these substances are sodium chloride and potassium chloride.

Alternatively, chloride ion may be supplied from a fluorescent brightening agent incorporated in the developer.

Examples of bromide ion-supplying substances include sodium bromide, potassium bromide, ammonium bromide, lithium bromide, calcium bromide, magnesium bromide, manganese bromide, nickel bromide, cadmium bromide, serium bromide, and thallium bromide. Preferred among these substances are potassium bromide and sodium bromide.

Chloride or bromide ion eluted from the light-sensitive material during development may both originate from an emulsion layer or other portions of the photographic material.

The color developer for use in the present invention preferably has a pH value of from 9 to 12, more preferably from 9 to 11. The color developer may further comprise compounds which are known to constitute color developers.

In order to maintain the above specified pH range, various buffers are preferably used. Useful buffers include carbonate, phosphate, borate, tetraborate, hydroxybenzoate, glycyl salt, N,N-dimethylglycine salt leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and licine salt. In particular, carbonate, phosphate, tetraborate, and hydroxybenzoate advantageously have an excellent buffering capacity at a high pH range as 9.0 or more, and do not adversely affect the photographic properties (e.g., fog) even when added to the color developer. Thus, these buffers are particularly preferred.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention should not be construed as being limited to these compounds.

The amount of the buffer added to the color developer is preferably in the range of from 0.1 mol/l or more, particularly 0.1 to 0.4 mol/l.

The color developer may further comprise various chelating agents such as calcium or magnesium precipitation inhibiting agents to improve the stability thereof. Specific examples of such agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycoletherdiaminetetraacetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

Two or more such chelating agents can be used in combination if desired.

The chelating agent is added to the color developer in an amount sufficient to block metallic ions in the color developer, e.g., 0.1 g to 10 g/l.

The color developer may optionally comprise a known development accelerator.

Examples of development accelerators for addition to the color developer include thioether compounds as disclosed in JP-B-37-16088, JP-B-37-5987, JP-B-38-7826, JP-B-44-12380, and JP-B-45-9019, and U.S. Pat. No. 3,813,247, p-phenylenediamine compounds as disclosed in JP-A-52-49829 and JP-A-50-15554, quaternary ammonium salts as disclosed in JP-A-50-137726, JP-A-56-156826 and JP-A-52-43429, and JP-B-44-30074, amine compounds as disclosed in U.S. Pat. Nos. 2,494,903, 3,128,182, 4,230,796, 3,253,919, 2,482,546, 2,596,926 and 3,582,346 and JP-B-41-11431, polyalkylene oxides as disclosed in JP-B-37-16088, JP-B-42-25201, JP-B-41-11431, and JP-B-42-23883, and U.S. Pat. Nos. 3,128,183, and 3,532,501, 1-phenyl-3-pyrazolidone and imidazole.

The color developer for use in the present invention can comprise a known fog inhibitor as necessary. Examples of the fog inhibitor include a halide of an alkaline metal such as sodium chloride, potassium bromide and potassium iodide, or an organic fog inhibitor. Typical examples of the organic fog inhibitor include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, and adenine.

The color developer for use in the present invention preferably contains a fluorescent brightening agent. A preferred fluorescent brightening agent is an 4,4'-diamino-2,2'-disulfostilbene compound. The fluorescent brightening agent is added to the color developer in an amount of from 0 to 5 g/l, preferably 0.1 to 4 g/l.

The color developer for use in the present invention may comprise various surface active agents such as alkysulfonic acid, arylsulfonic acid, aliphatic carboxylic acid and aromatic carboxylic acid as needed.

The color developer processing temperature is in the range of from 30° to 50° C., preferably 35° to 45° C. The color developer processing time is in the range of from 5 seconds to 30 seconds, preferably 5 seconds to 20 seconds, more preferably 5 seconds to 15 seconds. The replenishment rate of the color developer is preferably minimized, and is in the range of from 20 to 600 ml, preferably 30 to 100 ml per $m^2$ of the light-sensitive material.

The black-and-white developer may comprise known black-and-white developing agents such as dihydroxybenzenes (e.g., hydroquinone), 3-pyrazolidones (e.g., 1-phenyl-3-pyrazolidone) and aminophenols (e.g., N-methyl-p-aminophenol) alone or in combination.

These black-and-white developer generally has a pH of from 9 to 12.

The bleaching solution, blix solution and fixing solution for use in the present invention are described below.

The bleaching agent for use in the bleaching solution or blix solution can be a known bleaching agent. In particular, organic complexes of iron (III) (e.g., complexes of aminopolycarboxylic acids such as ethylenediaminetetraacetic acid and diethylenetriaminepentaacetic acid, aminopolysulphonic acid, phosphonocarboxylic acid, organic phosphonic acid), organic acids such as citric acid, tartartic acid and malic acid, persulfates, and hydrogen peroxide are preferably used.

Particularly preferred among these bleaching agents are organic complex salts of iron (III) in view of rapid processing and environmental protection. Examples of aminopolycarboxylic acids, aminopolyphosphonic acids, organic phosphonic acids and salts thereof useful for form in an organic complex salt of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycoletherdiaminetetraacetic acid. These compounds may be used in the form of a sodium salt, potassium salt, lithium salt or ammonium salt. Preferred among these compounds are complexes of iron (III) with ethylenediaminetetraacetic acid, diethylenetriaminepetaacetic acid, cyclohexanediaminetetraacetic acid, 1,3-diaminopropanetetraacetic acid and methyliminodiacetic acid, which exhibit a high bleaching capacity. These ferric complexes may be used in the form of a complex salt. Alternatively, a ferric salt such as ferric sulfate, ferric chloride, ferric nitrate, ferric ammonium sulfate and ferric phosphate, and a chelating agent such as aminopolycarboxylic acid, aminopolyphosphonic acid and phosphonocarboxylic acid may be used to form a ferric complex salt in solution. The chelating agent may be used in an amount exceeding that required to form a ferric complex salt. Preferred among these iron complexes are aminopolycarboxylic iron complexes, and the addition amount of the iron complex bleaching agent is in the range of from 0.01 to 1.0 mol/l, preferably 0.05 to 0.50 mol/l, more preferably 0.10 to 0.50 mol/l, particularly 0.15 to 0.40 mol/l.

The bleaching bath, blix bath and/or the prebath therof may comprise various compounds for use as a bleach accelerator. For example, compounds containing a mercapto group or disulfide bond as described in U.S. Pat. No. 3,893,858, German Patent 1,290,812, JP-A-53-95630, and *Research Disclosure* No. 17129 (July 1978), thiourea compounds as described in JP-B-45-8506, JP-A-2-20832, and JP-A-53-32735, and U.S. Pat. No. 3,706,561, or a halide such as iodide and bromide are preferably used due to their excellent bleaching capacity.

The bleaching solution or blix solution for use in the present invention may comprise a rehalogenating agent such as a bromide (e.g., potassium bromide, sodium bromide, ammonium bromide) a chloride (e.g., potassium chloride, sodium chloride, ammonium chloride), and an iodide (e.g., ammonium iodide). The bleaching solution or blix solution may optionally comprise one or more inorganic or organic acids having a pH buffering capacity and an alkaline metal or ammonium salts thereof such as borax, sodium metaborate, acetic acid, sodium acetate, sodium carbonate, potassium carbonate, phosphorous acid, phosphoric acid, sodium phosphate, citric acid, sodium citrate and tartaric acid, or a corrosion inhibitor such as ammonium nitrate and guanidine.

The blix solution or fixing solution may comprise a known fixing agent, e.g., a thiosulfate such as sodium thiosulfate and ammonium thiosulfate, a thiocyanate such as sodium thiocyanate and ammonium thiocyanate, a thioether compound such as ethylenebisthioglycolic acid and 3,6-dithia-1,8-octanediol, and a water-soluble silver halide solvent such as thiourea, singly or in admixture. Furthermore, a special blix solution comprising a combination of a fixing agent as described in JP-A-55-155354 and a large amount of a halide such as potassium iodide can be used. In the present invention, thiosulfates, particularly ammonium thiosulfate is preferably used. The content of the fixing agent is preferably in the range of from 0.3 to 2 mol, more preferably 0.5 to 1.0 mol per l.

The pH of the blix solution or fixing solution for use in the present invention is preferably in the range of from 3 to 8, more preferably 4 to 7. If the pH value falls below this range, the desilvering properties are improved, but deterioration of the processing solution and conversion of cyan dye to the corresponding leuco compound are accelerated. On the other hand, if the pH value exceeds this range, desilvering is retarded and stain readily occurs.

The pH of the bleaching bath for use in the present invention is preferably in the range of 8 or less, more preferably 2 to 7, particularly 2 to 6. If the pH value falls below this range, deterioration of the processing solution and conversion of cyan dye to a leuco compound are accelerated. On the other hand, if the pH value exceeds this range, desilvering is retarded and staining readily occurs.

In order to adjust the pH value of the processing solution, hydrochloric acid, sulfuric acid, nitric acid, bicarbonate, ammonia, caustic potash, caustic soda, sodium carbonate, potassium carbonate, etc. may be added to the system as necessary.

Furthermore, the blix solution can comprise various fluorescent brightening agents, antifoaming agent or surface active agents or organic solvents such as polyvinyl pyrrolidone and methanol.

The blix solution or fixing solution may preferably comprise as a preservative a sulfurous ion-releasing compound such as a sulfite (e.g., sodium sulfite, potassium sulfite, ammonium sulfite), bisulfite (e.g., ammonium bisulfite, sodium bisulfite, potassium bisulfite) and metabisulfite (e.g., potassium metabisulfite, sodium metabisulfite, ammonium metabisulfite). These compounds are preferably incorporated into the system in an amount of from about 0.02 to 1.0 mol/l, more preferably 0.04 to 0.60 mol/l, calculated in terms of sulfurous ion.

A sulfite is generally used as a preservative. Furthermore, ascorbic acid, carbonyl-bisulfurous acid adduct or carbonyl compounds may be used.

Furthermore, a buffer, a fluorescent brightening agent, a chelating agent, a mildewproofing agent or the like may be added to the system as necessary.

In the blix step of the present invention, the processing time is in the range of from 5 seconds to 120 seconds, preferably 10 seconds to 60 seconds. The processing temperature is in the range of from 25° C. to 60° C., preferably 30° C. to 50° C. The replenishment rate is in the range of from 20 ml to 250 ml, preferably 30 ml to 100 ml per $m^2$ of the light-sensitive material processed.

The desilvering process such as fixing and blix is normally followed by washing and/or stabilization.

The quantity of water for use in the washing step varies depending on the characteristics of the light-sensitive material (e.g., kind of couplers contained therein, etc.), the end use of the light-sensitive material, the temperature of the washing water, the number of washing tanks (number of stages), and other various factors. Of these factors, the relationship between the number of washing tanks and the quantity of water in a multi-stage countercurrent system can be obtained according to the method described in *Journal of the Society of Motion Picture and Television Engineers,* vol. 64, pp. 248–253 (May 1955). In general, the number of stages in the multi-stage countercurrent system is preferably 2 to 6, particularly 2 to 5.

By using a multi-stage countercurrent system, the requisite amount of washing water can be greatly reduced, e.g., to 500 ml or less per $m^2$ of the light-sensitive material processed (this amount corresponds to replenishment amount of water). However, bacteria tend to proliferate due to an increase of the retention time of water in the tank, and floating masses of bacteria adhere to the light-sensitive material. In the present invention, in order to alleviate this problem, the method of reducing calcium and magnesium ion concentrations as described in JP-A-62-288838 can be used very effectively. Furthermore, the use of isothiazolone compounds or thiabenzazoles as described in JP-A-57-8542, chlorine containing bactericides, e.g., chlorinated sodium isocyanurate, as described in JP-A-61-120145, benzotriazole as described in JP-A-61-267761, and bactericides described in Hiroshi Horiguchi, *Bokin-bobaizai no kagaku* published by Sankyo Shuppan (1986), Eisei Gijutu Gakkai (ed.), *Biseibutsu no mekkin, sakkin, bobaigijutsu* (1982) published by Kogyo Gijutsukai, and Nippon Bokin Bobi Gakkai (ed.), *Bokin bobaizai jiten,* 1986, is also effective.

The washing water may further contain a surface active agent as a hydro-extracting agent or a chelating agent such as EDTA as water softener.

The washing step may be followed by stabilization. Alternatively, the processing may proceed to stabilization without passing through a washing step. The stabilizing solution comprises a compound capable of stabilizing images. Examples of such a compound include an aldehyde compound such as formalin, a buffer for providing a film pH suitable for dye stabilization, and an ammonium compound. In order to inhibit the proliferation of bacteria in the solution or provide the processed light-sensitive material with mildewproofing properties, the above mentioned various germicides or mildewproofing agents may be used.

Furthermore, the stabilizing solution may comprise a surface active agent, a fluorescent brightening agent and a film hardener. If the processing of the light-sensitive material of the present invention proceeds directly to stabilization without being subjected to a washing step, the methods as described in JP-A-57-8543, JP-A-58-14834, and JP-A-60-220345 can be used.

In other preferred embodiments, chelating agents such as 1-hydroxyethylidene-1,1-diphosphonic acid and ethylenediaminetetramethylenephosphonic acid or magnesium or bismuth compound can be used.

The stabilizing processing may be carried out in the similar manner as that for the washing process described above.

A so-called rinsing solution may be used as washing solution or stabilizing solution for use after desilvering.

The washing solution or stabilizing solution preferably has a pH of from 4 to 10, more preferably 5 to 8. The temperature at which the processing solution is used varies depending on the intended use and properties of the light-sensitive material to be processed, and is generally in the range of from 20° to 50° C., preferably 25° to 45° C. The washing or stabilizing time is not particularly limited, and is preferably minimized to reduce processing time. The washing and/or stabilizing time is preferably in the range of 10 seconds to 60 seconds, more preferably 15 seconds to 45 seconds. The replenishment rate of the washing solution or stabilizing solution is preferably as small as possible in view of minimizing the running cost and the exhaust amount and in view of handleability.

In particular, the preferred replenishment rate of the washing solution or stabilizing solution is 0.5 to 50 times, preferably 3 to 40 times the amount of the solution carried over from the preceding bath per unit area of the light-sensitive material processed, or 500 ml or less, preferably 300 ml or less per $m^2$ of the light-sensitive material processed. The replenishment may be effected continuously or intermittently.

The solution which has been used in the washing step and/or stabilizing step may further be used in a preceding step. For example, in a multi-stage countercurrent system, the overflow from the washing tank can be introduced into its prebath, i.e., blix bath which is supplied with a concentrated blix solution (as a blix replenisher) to reduce the amount of waste solution.

The agitation of each processing bath of the present invention can be carried out in a known manner such by mechanical means or ultrasonic wave means. In particular, a method which directly acts on the surface of a light-sensitive material is preferably used. For example, pressure developed upon passage through a gap between a pair of rollers can be utilized. As disclosed in JP-A-62-183460, a method which comprises pumping the processing solution to be jetted through a slit or nozzle toward the emulsion surface of the light-sensitive material can be used. The spray speed at which the processing solution is incident upon the emulsion surface of the light-sensitive material is preferably as lage as possible so long as conveyance of the light-sensitive material is not interrupted. Generally, the spray speed is in the range of 0.3 to 3 m/sec.

The drying step for use in the present invention is described below. In order to effect ultrarapid processing of the present invention to complete image, the drying time is preferably in the range of from 10 seconds to 40 seconds.

As a means of reducing the drying time, one approach is to reduce the content of the hydrophilic binder such as gelatin of the light-sensitive material, to reduce the water content absorbed by the film furing processing. Furthermore, to reduce the amount of water carried over from the washing bath and to thereby expedite drying, a squeeze roller or cloth may be used to absorb water from the light-sensitive material shortly after removal from the washing bath, with respect to the drying apparatus, drying can be expedited by raising the temperature or intensifying circulation of the drying air. Furthermore, as described in JP-A-3-

157650, the angle of the drying air to the light-sensitive material can be adjusted, or an appropriate method of removing the exhausting air can be used to expedite drying.

A preferred embodiment of the present invention is described below with reference to the accompanying drawings, but the present invention should not be construed as being limited thereto.

FIG. 1 shows a silver salt system color paper processing machine of the present invention. This processing machine is adapted to develop, bleach-fix, wash with water and then dry a web color paper which has been exposed to light through a positive original to form an image thereon. The color paper to be processed by this processing machine (hereinafter referred to as "light-sensitive material") is a color photographic light-sensitive material comprising a support having thereon at least one silver halide emulsion layer containing silver chloride in an amount of 95 mol % or more. This light-sensitive material is color developed with a color developer containing a primary aromatic amine color developing agent.

In the main body of the processing machine 10 are provided developing baths 12, a blix bath 14, washing baths 16*a* to 16*e*, a hydro-extracting zone 17, and a drying zone 18 in sequence. A light-sensitive material 20 which has been exposed to light is subjected to development, blix and washing, dried at the drying zone 18, and then discharged from the main body of the processing machine 10.

In the developing baths 12, the blix bath 14, the washing baths 16*a* to 16*e*, the hydro-extracting zone 17, and the drying zone 18 are provided pairs of conveying rollers 24 for conveying the light-sensitive material 20 therebetween through these processing zones. The roller 24*a* operates first among the rollers. The conveying rollers 24 in the hydro-extracting zone 17 and the drying zone 18 also serve as dewatering rollers having a function of removing water from the surface of the light-sensitive material 20 by squeezing or absorbing. The light-sensitive material 20 is dipped into the processing solution for a predetermined period of time while being conveyed by the conveying rollers 24 with its emulsion side facing downward so that it is color-developed.

There are provided five washing baths 16*a* to 16*e*. These baths are piped in cascade connection. The purity of the washing water is progressively lower from the final stage bath 16*e* (most pure) towards the forefront stage bath 16*a* (most contaminated). These washing baths are equipped with a reverse osmotic membrane (RO membrane) apparatus 26. A pump 28 pumps the water from the 4th washing tank 16*d* into the reverse osmotic membrane apparatus 26. The purified filtrated water which has permeated through the reverse osmotic membrane apparatus 26 is then passed to the 5th washing bath 16*e* while the concentrated water (i.e., water containing solute in high concentration) which has been rejected by the reverse osmotic membrane apparatus 26 is then passed to the 4th washing bath 16*d*.

A fan 30 is provided below the drying zone 18 to provide hot air. The hot air provided by the fan 30 is passed to the drying zone 18 through slits 32, and then applied to the light-sensitive material 20 at a speed of 5 to 20 cm/sec. through nozzles installed crosswise at intervals of 1 cm to dry the light-sensitive material 20.

FIG. 2 is a diagrammatic view of the configuration in which the reverse osmotic membrane apparatus 26 is connected to the washing baths 16*d* and 16*e*. Inside the reverse osmotic membrane apparatus 26 is provided cylindrical reverse osmotic membrane 34 to define inside and outside chambers, respectively. In the outer chamber is provided a water inlet 36 through which water is pumped from the 4th washing bath 16*d* by the pump 28. To the outer and inner chambers of the reverse osmotic membrane apparatus 26 are provided water outlets 38 and 40, respectively. In the pipings 42*a*, 42*b* and 42*c*, which connect the reverse osmotic membrane apparatus 26 to the washing baths 16*d* and 16*e*, are provided valves 44, 46 and 48, respectively, as passage shut-off means. Water is passed only when the valves 44, 46 and 48 are opened. The valves 44, 46 and 48 are preferably electromagnetic valves to easily effect opening and closing electrically. While the processing machine is in operation, all the valves 44, 46 and 48 are opened, and water is pumped from the 4th washing bath 16*d* into the reverse osmotic membrane apparatus 26 by the pump 28. The water which has been passed to the reverse osmotic membrane apparatus 26 is then divided into two parts, i.e., filtrate (purified water) which has permeated through the reverse osmotic membrane 34 and concentrated water which has been rejected by the reverse osmotic membrane 34. The purified water is passed through the piping 42*c* to the 5th washing bath 16*e* while the concentrated water is recovered by the 4th washing bath 16*d* through the piping 42*b*.

When the operation of the processing machine is suspended, the valve 44 or the valve 44 and at least one of valves 46 and 48 are closed so that the water in the reverse osmotic membrane apparatus 26 is prevented from flowing out therefrom. When the operation of the processing machine is suspended to stop pumping of water by the pump 28, the water which has been subjected to reverse osmosis tends to flow in the osmotic direction to establish equilibrium in pressure between the inside and outside chambers separated by the reverse osmotic membrane 34. Thus, the purified water of the inside chamber tends to flow through the osmotic membrane 34 to the outside chamber. However, since the valve 44 or the valve 44 and at least one of valves 46 and 48 in the pipings 42*a*, 42*b* and 42*c*, which connect the outside and inside chambers to the washing baths 16*d* and 16*e*, respectively, are closed, water from the outside chamber is prevented from flowing out to the 4th washing bath 16*d*, and water from the outside chamber is prevented from flowing out to the 5th washing bath 16*e*. In other words, the water in the reverse osmotic membrane apparatus 26 is prevented from flowing backward through the piping 42*a* to the 4th washing bath 16*d*, or from flowing forward through the piping 42*b* to the 4th washing bath 16*d*, and from flowing forward through the piping 42*c* to the 5th washing bath 16*e*.

The opening and closing of the valves 44, 46 and 48 may be controlled in accordance with the conveyance timing of the light-sensitive material 20 determined by detection of the conveying condition of the light-sensitive material 20. For example, when it is determined that the light-sensitive material 20 has not been processed for a predetermined period of time, the valve or valves may be automatically closed. When the processing of the light-sensitive material is resumed, the rotation of, e.g., the conveying roller 24*a* of FIG. 1, which first operates among the rollers, may be detected to open the valves 44, 46 and 48 again.

Further, the opening and closing of the valves 44, 46 and 48 may be controlled syncronously with power on and off of the processing machine. In this arrangement, the valves 44, 46 and 48 are controlled to be opened when the power is on. The valves 44, 46 and 48 are also controlled to be closed to suspend the operation of the apparatus when the power is off.

The valve 44 provided at the inlet 36 side and the valve 48 provided at the purified water outlet 40 side may be check valves. Even if the opening and closing of these values are omitted, the same effects as discussed above can be obtained. If the valve 46 provided at the concentrated water discharge port 38 side is a check valve, the processing solution can enter into the 4th washing bath 16*d* from the reverse osmotic membrane apparatus 26 even while the operation of the processing machine is suspended. Thus, the valve 46 should not be a check valve.

FIG. 3 is a diagrammatic view of another embodiment of the washing bath. Washing baths 16*a* to 16*e* are piped in cascade connection as in the above described configuration. The light-sensitive material 20 is conveyed over the washing baths 16*a* to 16*e* almost horizontally with its emulsion side facing upward. The light-sensitive material 20 is conveyed by a belt, roller or the like (not shown). Each of the washing baths 16*a* to 16*e* is each provided with a drawing roller 50 for drawing up water from the washing bath to the light-sensitive material 20. The drawing roller 50 may rotate in the same direction as that of the conveyance of the light-sensitive material or in the opposite direction. The drawing rollers 50 may have the same or different diameters. In the case where the drawing rollers 50 have different diameters, the upstream roller 50 may have a larger diameter than the downstream roller 50. Below each of the drawing rollers 50 is provided a jetting means 52 for vigorously jetting the washing water towards the rollers 50. A reverse osmotic membrane apparatus 26 is installed in the same configuration as described above. In pipings 42*a*, 42*b* and 42*c* are provided valves 44, 46 and 48, respectively, for shutting off the passage upon suspension of the operation of the processing machine.

Figure 4:
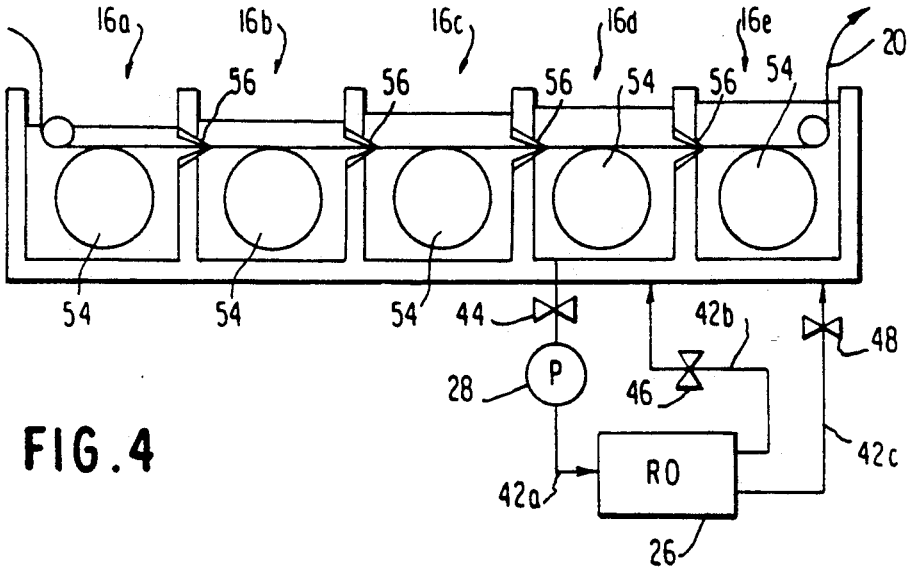
FIG. 4 is a diagrammatic view of another modified embodiment of washing bath.

FIG. 4 is a diagrammatic view of an alternative embodiment of the washing bath. Washing baths 16*a* to 16*e* are piped in cascade connection as in the above described configuration. In this arrangement, the light-sensitive material 20 is conveyed while being dipped in the washing water until the final bath. Each of the washing baths 16*a* to 16*e* is provided with a processing roller 54 which rotates in contact with the emulsion surface of the light-sensitive material 20. The light-sensitive material 20 is processed with water continuously supplied to the emulsion surface thereof by the processing roller 54 while being conveyed through the processing solution. Between the adjacent washing baths is a shutter means 56 for inhibiting carrying over of washing water to the next tank while enabling passage of the light-sensitive material 20. The shutter means 56 is made of, e.g., a pair of flexible members which are in elastic contact with each other at their ends. A reverse osmotic membrane apparatus 26 is provided in the same configuration as described above. Pipings 42*a*, 42*b* and 42*c* are provided with valves 44, 46 and 48, respectively, for shutting off the water passage upon suspension of the operation of the processing machine.

Figure 5:
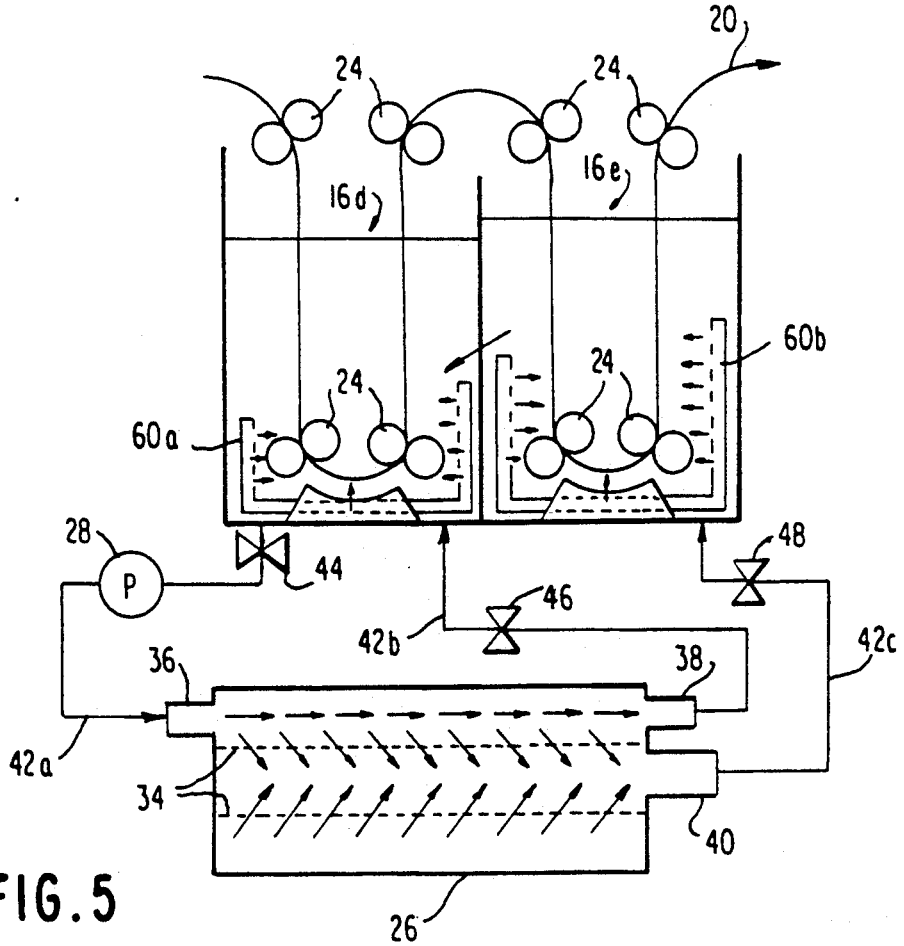
FIG. 5 is a diagrammatic view of a further modified embodiment of the washing bath, including the main body of the processing apparatus 10, developing bath 12, blix bath 14, washing bath 16, hydro-extracting zone 17, drying zone 18, light-sensitive material 20, a pair of conveying rollers 24, reverse osmotic membrane apparatus 26, pump 28, fan 30, slit 32, reverse osmotic membrane 34, inlet 36, outlets 38 and 40, pipes 42*a*, 42*b* and 42*c* valves 44, 46 and 48, processing solution drawing roller 50, processing solution jetting means 52, processing roller 54, shutter means 56, and processing solution jetting members 60 and 60*b*.

FIG. 5 is a diagrammatic view of a further embodiment of the washing bath which is a remodelled version of the washing bath shown in FIG. 2. This embodiment is similar to that shown in FIG. 2 except that the washing baths 16*d* and 16*e* are equipped with jetting members 60*a* and 60*b* for vigorously jetting the washing water to the emulsion surface of the light-sensitive material 20 which is being conveyed by conveying rollers 24, respectively. The jetting members 60*a* and 60*b* are hollow and have a plurality of micropores or slits on the side opposing the emulsion surface of the light-sensitive material 20. The jetting member 60*a* in the 4th washing bath 16*d* is connected to an outlet 38 of a reverse osmotic membrane apparatus 26 through a piping 42*b*, and the jetting member 60*b* in the 5th washing bath 16*e* is connected to the other outlet 40 of the reverse osmotic membrane apparatus 26. The purified water which has permeated through the reverse osmotic membrane 34 is passed through a piping 42*c* to replenish the 5th washing bath 16*e*. The concentrated water which has been rejected by the reverse osmotic membrane 34 is recovered by the 4th washing bath 16*d* through a piping 42*b*.

In the configuration wherein the filtrate and concentratede water are jetted from the injection members 60*a* and 60*b*, respectively, the jetted solutions can be pointed to directly collide with the light-sensitive material, to thereby more rapidly clean contaminants away from the light-sensitive material. Thus, this processing machine provides a high image quality with reduced stain.

The same apparatus as that for washing process described above can be applied for stabilizing process.

In accordance with the present invention, a passage shut-off means is provided in a piping connecting a washing bath or stabilizing bath and a reverse osmotic membrane apparatus, or in each of a piping connecting a washing bath and a reverse osmotic membrane apparatus and a piping connecting a stabilizing bath and a reverse osmotic membrane apparatus. Operation of the passage shut-off means to shut-off the piping while operation of the processing machine is suspended prevents the processing solution in the reverse osmotic membrane apparatus from flowing into the washing bath and/or stabilizing bath. The present invetnion prevents the processing solution in the washing bath and/or stabilizing bath from unnecessarily overflowing to thereby maintain the desired liquid level and provide stable processing (i.e., stable photographic properties).

In particular, the present invention effectively suppresses fluctuation in photographic properties in the case there the capacity of the bath used in washing step or stabilizing step is as small.

The present invention is further described in the following Examples, but the present invention should not be construed as being limited thereto.

EXAMPLE 1

Preparation of Light-sensitive Material 1

The surface of paper support of which both surfaces were laminated with a polyethylene was subjected to corona discharge. On the paper support was provided a gelatin undercoating layer containing sodium dodecylbenzenesulfonate. On the undercoating layer were coated various photographic constituent layers to prepare a multilayer color photographic paper having the following layer construction (light-sensitive material 1). The coating solutions were prepared as follows:

Preparation of 5th Layer Coating Solution

To 32.0 g of a cyan coupler (ExC), 3.0 g of a dye image stabilizer (Cpd-2), 2.0 g of a dye image stabilizer (Cpd-4), 18.0 of a dye image stabilizer (Cpd-6), 40.0 g of a dye image stabilizer (Cpd-7) and 5.0 g of a dye image stabilizer (Cpd-8) were added 50.0 ml of ethyl acetate and 14.0 g of a solvent (Solv-6) to make a solution. The solution thus obtained was then added to 500 ml of a 20 wt % aqueous solution of gelatin containing 8 ml of sodium dodecylbenzenesulfonate. The mixture was then subjected to emulsion dispersion by means of an ultrasonic homogenizer to prepare an emulsion dispersion. On the other hand, a silver bromochloride emulsion (1:4 (Ag molar ratio) mixture of a large size emulsion of cubic grains having an average size of 0.58 μm with a grain size distribution fluctuation coefficient of 0.09 and a small size emulsion of cubic grains having an average size of 0.45 μm with a grain size distribution fluctuation coefficient of 0.11, 0.6 mol % of silver bromide being localized partially on the surface of each emulsion) was prepared. This emulsion comprised a red-sensitive sensitizing dye E having the chemical structure set forth below in an amount of $0.9\times10^{-4}$ mol per mol of Ag for the large size emulsion and $1.1\times10^{-4}$ mole per mol of Ag for the small size emulsion. The chemical ripening of this emulsion was carried out by the addition of a sulfur sensitizer and a gold sensitizer. The previously prepared emulsion dispersion and the red-sensitive silver bromochloride emulsion were mixed to prepare a coating solution for the 5th layer having the formulations set forth below.

The coating solutions for the 1st layer to the 4th layer, the 6th layer and the 7th layer were prepared in the same manner as the coating solution for the 5th layer. A gelatin hardener used for each layer was sodium salt of 1-oxy-3,5-dichloro-s-triazine.

To each of these layers were added Cpd-10 and Cpd-11 in a total amount of 25.0 mg/m$^2$ and 50.0 mg/m$^2$, respectively.

To the blue-sensitive emulsion layer were added a sensitizing dye A and a sensitizing dye B having the chemical structure set forth below in an amount of $2.0\times10^{-4}$ mol per mol of silver halide for the large size emulsion and $2.5\times10^{-4}$ mol per mol of silver halide for the small size emulsion, respectively.

Blue-sensitive Emulsion Layer

Sensitizing dye A

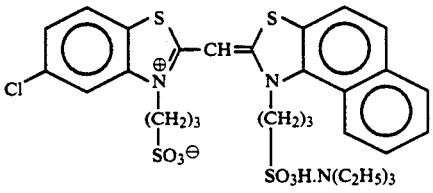

Sensitizing dye B

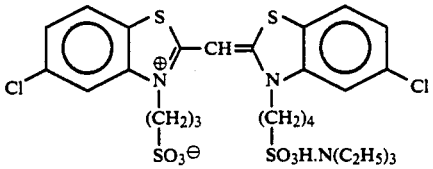

To the green-sensitive emulsion layer were added a sensitizing dye C having the chemical structure set forth below in an amount of $4.0\times10^{-4}$ mol per mol of silver halide for the large size emulsion and $5.6\times10^{-4}$ mol per mol of silver halide for the small size emulsion and a sensitizing dye D having the chemical structure set forth below in an amount of $7.0\times10^{-5}$ mol per mol of silver halide for the large size emulsion and $1.0\times10^{-5}$ mol per mol of silver halide for the small size emulsion.

Green-sensitive Emulsion Layer

Sensitizing dye C

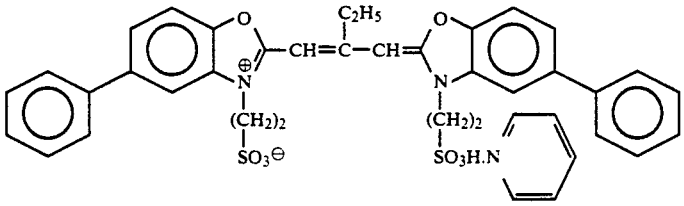

Sensitizing dye D

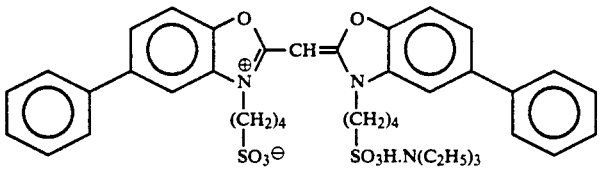

To the red-sensitive emulsion layer were added a sensitizing dye E having the chemical structure set forth below in an amount of $0.9\times10^{-4}$ mol per mol of silver halide for the large size emulsion and $1.1\times10^{-4}$ mol per mol of silver halide for the small size emulsion.

Red-sensitive Emulsion layer

Sensitizing dye E

-continued

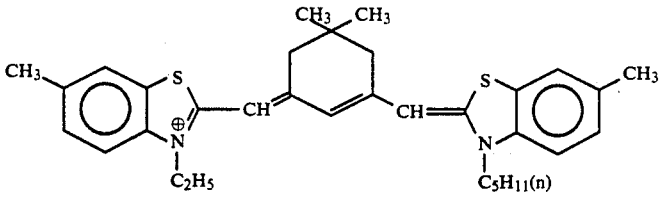

Furthermore, a compound H having the chemical structure set forth below was added to the system in an amount of $2.6\times10^{-3}$ mol per mol of silver halide.

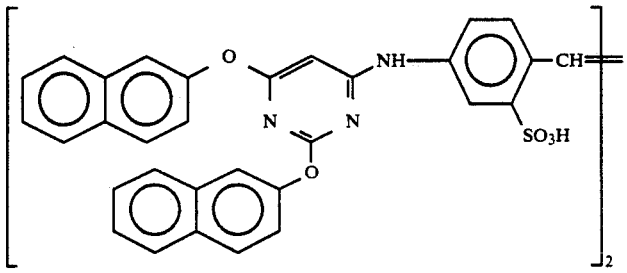

To each of the blue-sensitive emulsion layer, the green-sensitive emulsion layer and the red-sensitive emulsion layer were added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and the green-sensitive emulsion layer were each added 4-hydroxy-6-methyl-1,3,3a,7-tetrazaindene in amounts of $1\times10^{-4}$ mol and $2\times10^{-4}$ mol per mol of silver halide, respectively. For the purpose of inhibiting irradiation, to each of the emulsion layers were added the following dyes (figures in parenthesis indicate the coated amount):

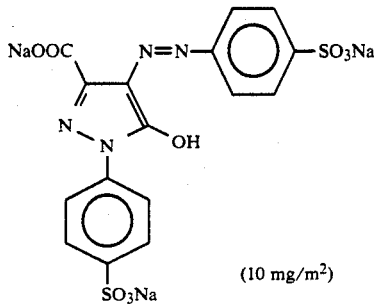

(10 mg/m²)

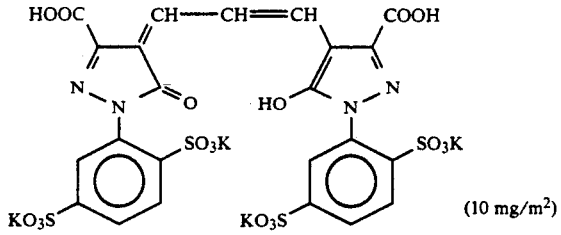

(10 mg/m²)

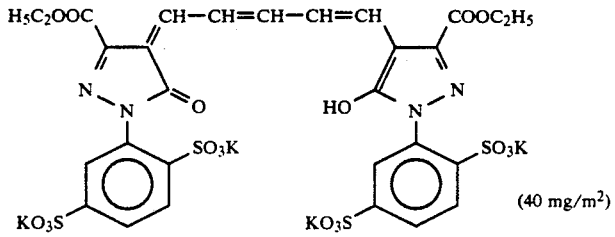

(40 mg/m²)

and

-continued

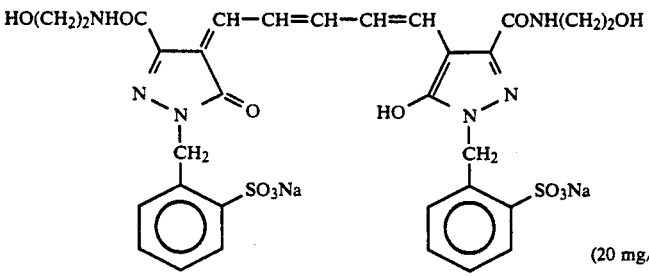

(20 mg/m²)

Layer Construction

The formulations of the various layers are set forth below. The figures indicate the coated amount (g/m²). The coated amount of silver halide in a silver halide emulsion as represented below is calculated in terms of silver.

| Support | |
|---|---|
| Polyethylene-laminated paper | |
| [containing a white pigment ($TiO_2$) and a bluish dye (ultramarine) in polyethylene on the lst layer side] | |
| 1st layer (blue-sensitive emulsion layer) | |
| Silver bromochloride in emulsion (3:7 (Ag molar ratio) mixture of a large size emulsion of cubic grains having an average size of 0.88 μm with a grain size distribution fluctuation coefficient of 0.88 and a small size emulsion of cubic grains having an average size of 0.70 μm with a grain size distribution fluctuation coefficient of 0.10, 0.3 mol % of silver bromide being localized partially on the surface of each emulsion) | 0.25 |
| Gelatin | 1.07 |
| Yellow coupler (ExY) | 0.62 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| 2nd layer (color mixing inhibiting layer) | |
| Gelatin | 1.25 |
| Color mixing inhibitor (Cpd-5) | 0.08 |
| Solvent (Solv-1) | 0.16 |
| Solvent (Solv-4) | 0.08 |
| 3rd layer (green-sensitive emulsion layer) | |
| Silver bromochloride in emulsion (1:3 (Ag molar ratio) mixture of a large size emulsion of cubic grains having an average size of 0.55 μm with a grain size distribution fluctuation coefficient of 0.10 and a small size emulsion of cubic grains having an average size of 0.39 μm with a grain size distribution fluctuation coefficient of 0.08, 0.8 mol % of silver bromide being localized partially on the surface of each emulsion) | 0.12 |
| Gelatin | 1.24 |
| Magenta coupler (ExM) | 0.17 |
| Dye image stabilizer (Cpd-2) | 0.03 |
| Dye image stabilizer (Cpd-3) | 0.16 |
| Dye image stabilizer (Cpd 4) | 0.02 |
| Dye image stabilizer (Cpd-9) | 0.02 |
| Solvent (Solv-2) | 0.40 |
| 4th layer (ultraviolet absorbing layer) | |
| Gelatin | 1.42 |
| Ultraviolet absorbent (UV-1) | 0.47 |
| Color mixing inhibitor (Cpd-5) | 0.05 |
| Solvent (Solv-5) | 0.24 |
| 5th layer (red-sensitive emulsion layer) | |
| Silver bromochloride in emulsion (1:4 (Ag molar ratio) mixture of a large size emulsion of cubic grains having an average size of 0.58 μm with a grain size distribution fluctuation coefficient of 0.09 and a small size emulsion of cubic grains having an average size of 0.45 μm with a grain size distribution fluctuation coefficient of 0.11, 0.6 mol % of silver bromide being localized partially on the surface of each emulsion) | 0.20 |
| Gelatin | 0.91 |
| Cyan coupler (ExC) | 0.35 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th layer (ultraviolet absorbing layer) | |
| Gelatin | 0.48 |
| Ultraviolet absorbent (UV-1) | 0.16 |
| Color mixing inhibitor (Cpd-5) | 0.02 |
| Solvent (Solv-5) | 0.08 |
| 7th layer (protective layer) | |
| Gelatin | 1.12 |
| Acryl-modified copolymer of polyvinyl alcohol (modification degree: 17%) | 0.17 |
| Liquid paraffin | 0.03 |

The chemical structures of the compounds incorporated in these layers are set forth below.

Yellow coupler (ExY)
1:1 (molar ratio) mixture of

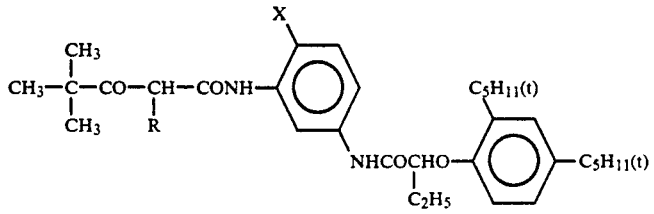

-continued
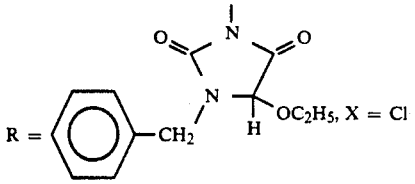
and
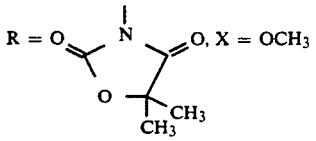
Magenta coupler (ExM)
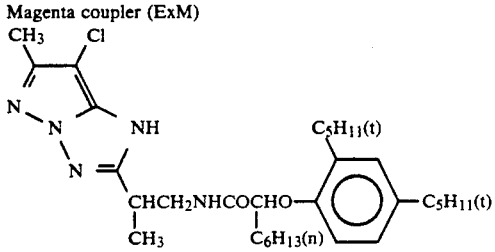
Cyan coupler (ExC)
1:1 (molar ratio) mixture of
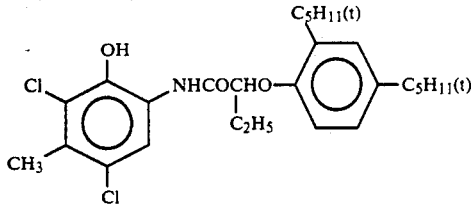
and
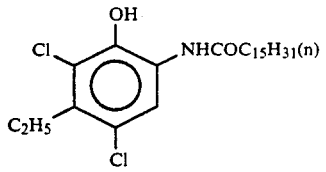
Dye stabilizer (Cpd-1)
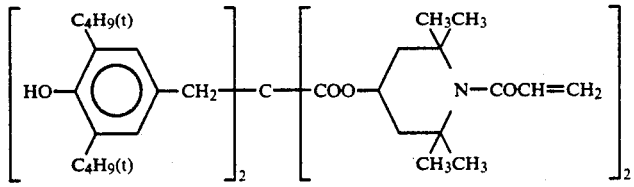
Dye stabilizer (Cpd-2)
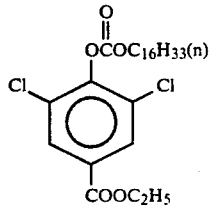
Dye stabilizer (Cpd-3)

-continued
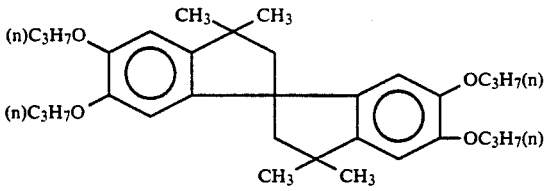
Dye stabilizer (Cpd-4)
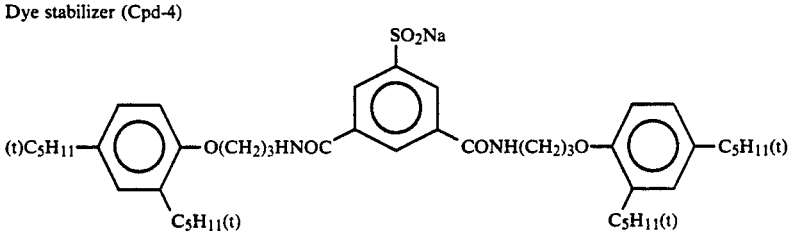
Color mixing inhibitor (Cpd-5)
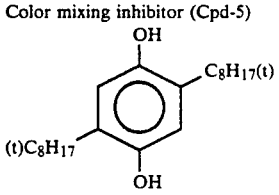
Dye image stabilizer (Cpd-6)
2:4:4 (weight ratio) mixture of
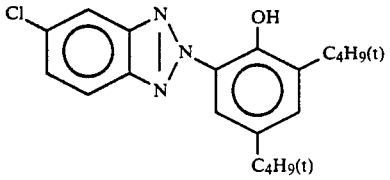
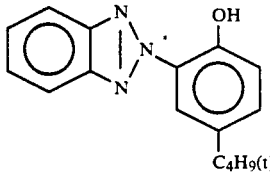
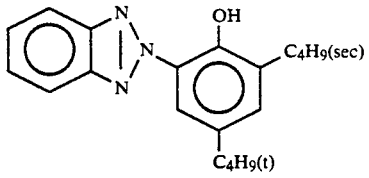
Dye image stabilizer (Cpd-7)
$$\left(CH_2-\underset{\underset{CONHC_4H_9(t)}{|}}{CH}\right)_n$$
(Average molecular weight 60,000)
Dye image stabilizer (Cpd-8)
1:1 (weight ratio) mixture of
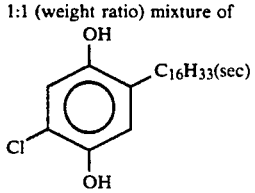
and
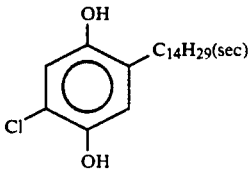
Dye image stabilizer (Cpd-9)

-continued
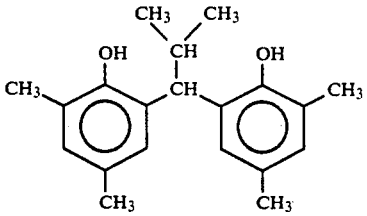
Preservative (Cpd-10)
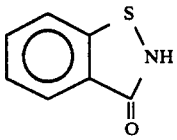
Preservative (Cpd-11)
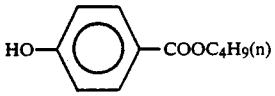
Ultraviolet absorbent (UV-1)
4:2:4 (weight ratio) mixture of
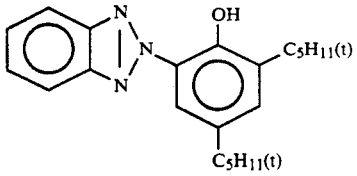
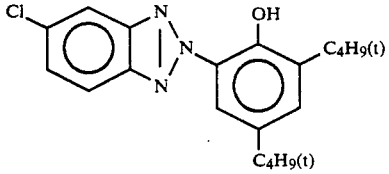
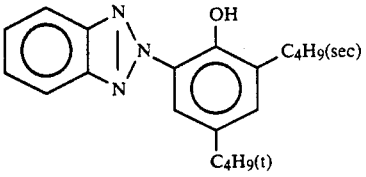
Solvent (Solv-1)
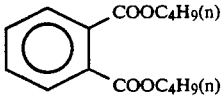
Solvent (Solv-2)
1:1 (volumetric ratio) mixture of
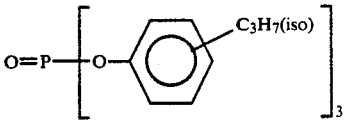
and
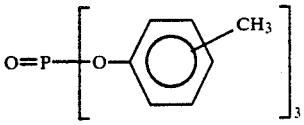
Solvent (Solv-3)

-continued $O{=}P{+}O{-}C_9H_{19}(iso)]_3$

Solvent (Solv-4)

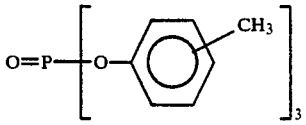

Solvent (Solv-5)

$COOC_8H_{17}(n)$
|
$(CH_2)_8$
|
$COOC_8H_{17}(n)$

Solvent (Solv-6)

80:20 (volumetric ratio) mixture of

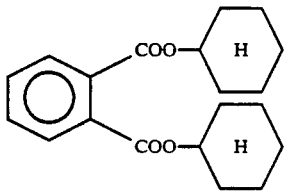

and $(n)C_8H_{17}CHCH(CH_2)_7COOC_8H_{17}(n)$
\ /
O

Solvent (Solv-7)

$(n)C_8H_{17}CHCH(CH_2)_7COOC_8H_{17}(n)$
\ /
O

The light-sensitive material 1 was stepwise exposed to light through a three color separation filter for sensitometry using a sensitometer (Type FW produced by Fuji Photo Film Co., Ltd.; color temperature of light source: 3,200° K.). The exposure was effected to provide 250 CMS for a 0.1 second exposure.

The specimen which had been exposed was then processed by a processing apparatus having the configuration set forth in FIG. 1 which is an embodiment of the present invention.

| Processing Step | Temperature | Time | Replenisher* | Tank Capacity |
|---|---|---|---|---|
| Color Development | 38.5° C. | 45 sec. | 73 ml | 23.0 l |
| Blix | 38.0° C. | 20 sec. | 60 ml | 11.5 l |
| Rinse 1 | 40.0° C. | 7 sec. | — | 2.0 l |
| Rinse 2 | 40.0° C. | 7 sec. | — | 2.0 l |
| Rinse 3 | 40.0° C. | 7 sec. | — | 2.0 l |
| Rinse 4 | 40.0° C. | 7 sec. | — | 2.0 l |
| Rinse 5 | 40.0° C. | 7 sec. | 60 ml | 2.0 l |
| Drying | 70–80° C. | 15 sec. | | |

*The replenishment rate is represented per $m^2$ of light-sensitive material processed.

In each of rinse baths, jet agitation was employed to apply a water jet vertically to the surface of the light-sensitive material. The rinse step was effected in a countercurrent process wherein the washing water overflaw from Rinse 5 was introduced into Rinse 4, the overflow from Rinse 4 was introduced into Rinse 3, the overflow from Rinse 3 was introduced into Rinse 2, the overflow from rinse 2 was introduced into Rinse 1 (i.e., countercurrent cascade), and the over flow from rinse 1 was introduced to the blix bath.

As the reverse osmotic membrane there was used a spiral type RO module element DRA-80 produced by Dicel Kagaku Kogyo K.K. was used (effective membrane surface area: 1.1 $m^2$; diameter: 61 mm; length: 60 cm; polysulfone composite membrane). This reverse osmotic membrane was mounted in a plastic pressure-resistant vessel PV-0321 produced by Dicel Kagaku Kogyo K.K.

The reverse osmotic membrane was installed as shown in FIGS. 1 and 5. The washing water in the 4th washing bath was pumped through the reverse osmotic membrane at a pump pressure of 7 $kg/cm^2$ and a flow rate of 1.8 l/min. The filtrate of the reverse osmotic membrane was passed to the 5th rinsing bath, while the concentrated water was passed back to the 4th washing bath. The rate of flow of the filtrate to the 5th washing bath was 140 to 400 ml/min.

The pump used was a D7349 pump produced by Tuthill (maximum discharge pressure: 9 $kg/cm^2$). The check valve used was a 980 series check valve produced by Mase (operating pressure: 6 seconds (water-gauge pressure)).

Furthermore, the reverse osmotic membrane apparatus was operated between 30 minutes before the processing of the light-sensitive material and 30 minutes after the completion of the processing of the light-sensitive material. The system was designed such that when the operation of the reverse osmotic membrane apparatus is suspended, all the three valves, i.e., the two valves provided between the 4th washing bath and the reverse osmotic membrane apparatus and the valve provided between the 5th washing bath and the reverse osmotic membrane apparatus are closed. These valves were designed to be automatically opened when the operation of the system is resumed. The opening and closing of these valves was controlled by detection of the conveying roller designated by the reference numeral 26*a* in FIG. 1.

The formulations of the various processing solutions were as follows:

| | Solution in Tank | Replenisher |
|---|---|---|
| Color Developer | | |
| Water | 700 ml | 700 ml |
| Sodium triisopropyl-naphthalene (β) sulfonate | 0.1 g | 0.1 g |
| Ethylenediaminetetraacetate | 3.0 g | 3.0 g |
| Disodium 1,2-dihydroxy-benzene-4,6-disulfonate | 0.5 g | 0.5 g |
| Triethanolamine | 12.0 g | 12.0 g |
| potassium chloride | 6.5 g | — |
| Potassium bromide | 0.03 g | — |
| Potassium carbonate | 27.0 g | 27.0 g |
| Fluorescent brightening agent (Whitex 4KB produced by Sumitomo Chemical Co., Ltd.) | 1.3 g | 3.9 g |
| Sodium sulfite | 0.1 g | 0.1 g |
| Disodium N,N-bis(sulfonate-ethyl)hydroxylamine | 10.0 g | 13.0 g |
| N-ethyl-N-(β-methanesulfon-amidoethyl)-3-methyl-4-amino-anilinesulfate | 5.0 g | 11.5 g |
| Water to make | 1,000 ml | 1,000 ml |
| pH (25° C.) | 10.00 | 11.00 |
| Blix solution | | |
| Water | 400 ml | 400 ml |
| Ammonium thiosulfate (70 wt % aqueous solution) | 110 ml | 220 ml |
| Ethylenediaminetetraacetate | 1.5 ml | 3.0 ml |
| Ammonium sulfite (monohydrate) | 19.4 g | 38.80 g |
| Ammonium bromide | 25 g | 50 g |
| Acetic acid (90 wt % aqueous solution) | 6.57 g | 13.13 g |
| Ferric ammonium ethylenedi-aminetetraacetate (dihydrate) | 73 g | 143 g |
| Nitric acid (67 wt % aqueous solution) | 18.29 | 36.58 |
| Water to make | 1,000 ml | 1,000 ml |
| pH (25° C.) | 5.00 | 4.80 |

Rinsing Solution (The Solution in the Tank was the Same as the Replenisher).

Ion-exchanged water (calcium and magnesium concentration was not more than 3 ppm each)

The light-sensitive material was processed at a rate of 40 $m^2$ a day. Temperature control of the various processing baths was maintained for 10 hours a day (during processing). These processing baths were neither heated nor cooled at other times. On each processing day, the evaporation from the processing baths which had been previously measured was compensated by the addition of water. This processing lasted 30 days.

EXAMPLE 2

The same processing and apparatus were effected as in Example 1 except that the light-sensitive material specimens which had been processed on the 1st day, 7th day, 14th day, 21st day and 30th day after the beginning of the test were stored at a temperature of 70° C. and a humidity of 70% for 7 days. For the evaluation of stain, these specimens were measured for increase in minimum yellow density with time. The specimens (which had been processed according to the present invention) exhibited a density increase of 0.01.

The same processing and apparatus were effected as above in this Example, except that the valves were not closed while operation of the reverse osmotic membrane apparatus was suspended. The specimens thus obtained exhibited a density increase of from 0.05 to 0.27.

Furthermore, when the specimens were processed without closing the valves, 300 to 500 ml of the processing solution leaked to the periphery of the processing machine. However, when the apparatus of FIG. 1 was used, no leakage of processing solution was observed.

Thus, it was determined that the apparatus of the present invention provided the intended effect.

The same processing and apparatus were effected as above in this Example according on the present invention except that the washing baths 1 to 5 each had a capacity of 5l. The specimens exhibited a density increase of 0.01 to 0.04. Thus, it was determined that the effects of the present invention are pronounced for washing baths of a smaller capacity. It is considered that the increase in capacity of the washing baths allows for appropriate effective washing time even when some of the washing solution is lost by overflow.

COMPARATIVE EXAMPLE 1

The same processing and apparatus were effected as in Example 1 without closing the valves and except that the rate of replenishment from the washing bath 5 was set to 200 ml/$m^2$. The processing solution was replenished with the start of processing. A sample processed shortly after the beginning of processing exhibited a high degree of staining. However, the high replenishment rate provided early restoration to the normal running state. Although the normal running state provided acceptable photographic properties, undesirable problems resulted such as overflow of the processing solution upon suspension of the operation of the system. On the other hand, the present invention provides excellent photographic properties even at a low replenishment rate.

EXAMPLE 3

The same test was effected as in Example 1, except that the light-sensitive material 2 set forth below was used instead of the light-sensitive material 1 of Example 1.

(Preparation of Emulsion a)

To a 3 wt % aqueous solution of lime-treated gelatin was added 3.3 g of sodium chloride. To the mixture was added 3.2 ml of a 2 wt % aqueous solution of N,N'-dimethylimidazolidine-2-thione. To this aqueous solution were added an aqueous solution containing 0.2 mol of silver nitrate and an aqueous solution containing 0.1 mol of sodium chloride and 15 μg of rhodium trichloride with vigorous stirring at a temperature of 56° C. To this aqueous solution were then added an aqueous solution containing 0.780 mol of silver nitrate and an aqueous solution containing 0.780 mol of sodium chloride and 4.2 mg of potassium ferrocyanate with vigorous stirring at a temperature of 56° C. Five minutes after completion of the addition of the aqueous solution of silver and the aqueous solution of halogenated alkali, an aqueous solution containing 0.020 mol of silver nitrate and an aqueous solution containing 0.015 mol of potassium bromide, 0.005 mol of sodium chloride and 0.8 mg of potassium hexachloroiridiumate (IV) were added to the system with vigorous stirring at a temperature of 40° C. To the system was then added a copolymer of monosodium maleate and isobutene. The system was then sedimentation-rinsed to effect desalting. 90.0 g of lime-treated gelatin was then added to the system, and the pH value and pAg value thereof were adjusted to 6.2 and 6.5, respectively. The system was then subjected to optimum chemical sensitization with $1\times10^{-5}$ mol/mol Ag using a sulfur sensitizer (triethylthiourea), $1\times10^{-5}$ mol/mol Ag of chloroauric acid and 0.2 g/mol Ag of nucleic acid at a temperature of 50° C.

The silver bromochloride emulsion (a) thus obtained was then evaluated for grain shape, grain size and grain size distribution from electron microscopic-photographs. The silver halide grains thus prepared were cubic grains having a size of 0.52 μm with a fluctuation coefficient of 0.08. The grain size was represented by the average of diameter of circles equivalent to the projected area of the grains, and the grain size distribution was obtained by dividing the standard deviation of the grain sizes by the average grain size.

The halogen composition of the emulsion grain was determined by measuring the X-ray diffraction from the silver halide crystal. The X-ray source was a monochromatized Cuk α-ray. The angle of diffraction from the 200 plane was specifically measured. The crystal having a uniform halogen composition provided diffraction with a single peak, while the crystal having localized phases with different compositions provided diffraction with a plurality of peaks corresponding to these compositions. By calculating the lattice constant from the peak diffraction angle thus measured, the halogen composition of silver halide constituting the crystal can be determined. From the results of the measurement of the silver bromochloride emulsion (a), a broad diffraction pattern with a main peak corresponding to 100% silver chloride, a central peak corresponding to 70 mol % silver chloride (30 mol % silver bromide) and a skirt spread to a point corresponding to 60 mol % silver chloride (40 mol % silver bromide) was observed.

Preparation of Light-sensitive Material 2

The surface of a paper support of which both surfaces were laminated with a polyethylene was subjected to corona discharge. On the paper support was provided a gelatin undercoating layer containing sodium dodecylbenzenesulfonate. On the undercoating layer were coated various photographic constituent layers to prepare a multilayer color photographic paper having the following layer construction (light-sensitive material 2). The coating solutions were prepared as follows:

Preparation of 1st Layer Coating Solution

To 19.1 g of a yellow coupler (ExY) and 4.4 g of a dye image stabilizer (Cpd-1) and 0.7 g of a dye image stabilizer (Cpd-7) were added 27.2 ml of ethyl acetate and 4.1 g of each of a solvent (Solv-3) and a solvent (Solv-7) to make a solution. The solution thus obtained was then emulsion-dispersed in 185 ml of a 10 wt % aqueous solution of gelatin containing 8 ml of 10 wt % sodium dodecylbenzenesulfonate. On the other hand, an emulsion was prepared by adding red-sensitive sensitizing dye (Dye-1 and Dye-2) having the chemical structure set forth below to the silver bromochloride emulsion (a). This emulsion was then mixed with the above mentioned emulsion dispersion to prepare a coating solution for the 1st layer having the formulations set forth below.

The coating solutions for the 2nd layer to the 7th layer were prepared in the same manner as the coating solution for the 1st layer. A gelatin hardener used for each layer was the sodium salt of 1-oxy-3,5- dichloro-s-triazine.

To each of these layers were added Cpd-10 and Cpd-11 in total amounts of 25.0 mg/m$^2$ and 50.0 mg/m$^2$, respectively. The following compounds were used as spectral sensitizing dyes for each layer;

1st layer: red-sensitive yellow coloring layer (Dye-1)

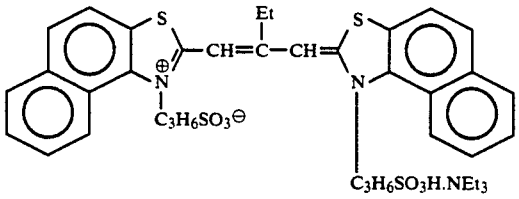

($1.0\times10^{-4}$ mol per mol of silver halide)

(Dye-2)

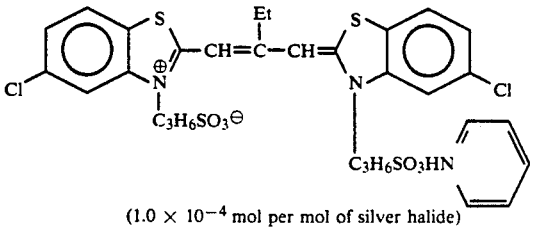

($1.0\times10^{-4}$ mol per mol of silver halide)

3rd layer: infrared-sensitive magenta coloring layer

-continued (Dye-3)

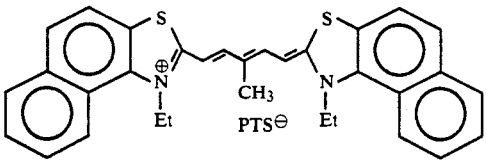

(4.5 × $10^{-5}$ mol per mol of silver halide)
PTS⊖: p-toluenesulfate ion

5th layer: red-sensitive cyan coloring layer (Dye-4)

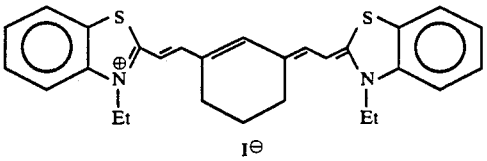

(1 × $10^{-5}$ mol per mol of silver halide)

(Dye-5)

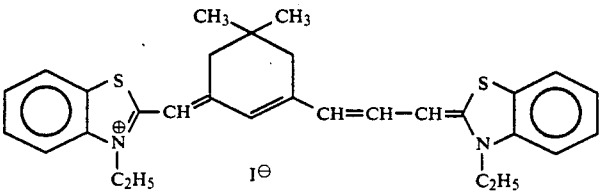

(1 × $10^{-5}$ mol per mol of silver halide)

(Dye-6)

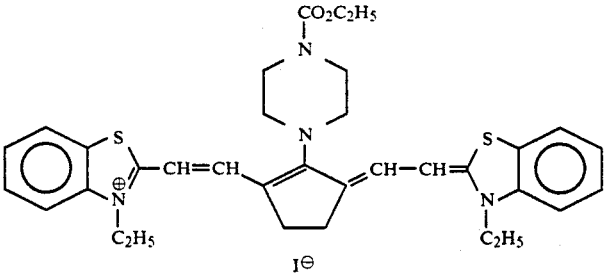

(1 × $10^{-5}$ mol per mol of silver halide)

To each of the yellow coloring emulsion layer, magenta coloring emulsion layer and cyan coloring emulsion layer were added 1-(5-methylureidophenyl)-5-mercaptotetrazole in an amount of $8.0\times10^{-4}$ mol per mol of silver halide.

For the purpose of inhibiting irradiation, the following dyes were added to each of the emulsion layers:

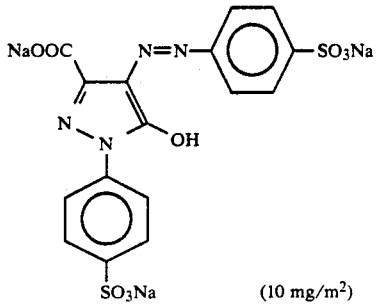

(10 mg/$m^2$)

-continued

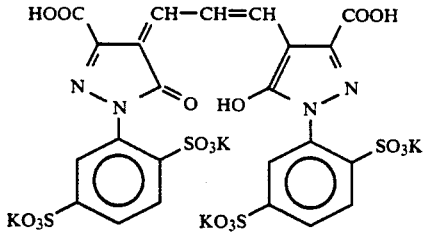

(10 mg/m²)

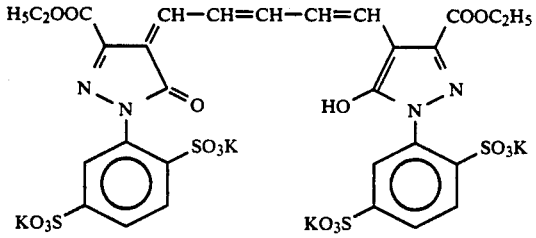

(40 mg/m²)

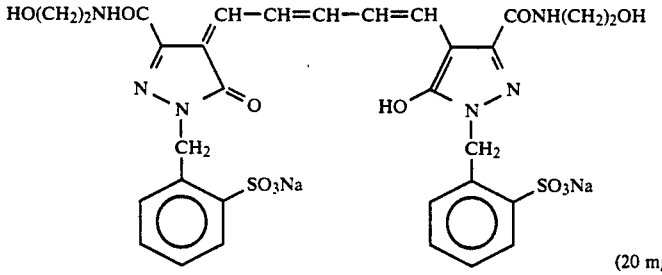

(20 mg/m²)

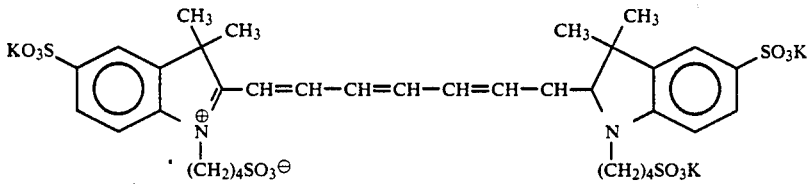

(10 mg/m²)

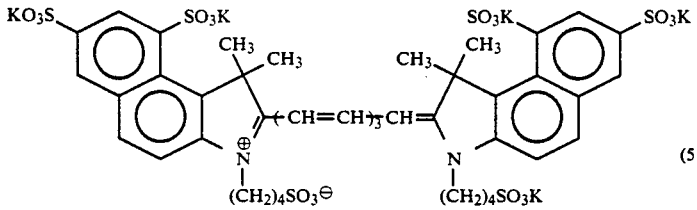

(5 mg/m²)

and

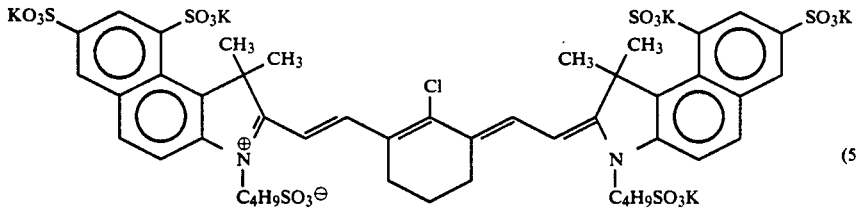

(5 mg/m²)

Layer Construction

The formulations of the various layers are set forth below. The figures indicate the coated amount (g/m²). The coated amount of silver halide in a silver halide emulsion as represented below is calculated in terms of silver.

| Support | |
|---|---|
| Polyethylene-laminated paper [containing a white pigment ($TiO_2$) and a bluish dye (ultramarine) in polyethylene on the lst layer side] | |
| 1st layer (red-sensitive emulsion layer) | |
| Silver bromochloride in emulsion (a) | 0.30 |
| Gelatin | 1.22 |

-continued

| Support | |
|---|---|
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| 2nd layer (color mixing inhibiting layer) | |
| Gelatin | 0.64 |
| Color mixing inhibitor (Cpd-5) | 0.10 |
| Solvent (Solv-1) | 0.16 |
| Solvent (Solv-4) | 0.08 |
| 3rd layer (infrared-sensitive magenta coloring layer) | |
| Silver bromochloride in emulsion (a) | 0.12 |
| Gelatin | 1.28 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th layer (ultraviolet absorbing layer) | |
| Gelatin | 1.41 |
| Ultraviolet absorbent (UV-1) | 0.47 |
| Color stain inhibitor (Cpd-5) | 0.05 |
| Solvent (Solv-5) | 0.24 |
| 5th layer (infrared-sensitive cyan coloring layer) | |
| Silver bromochloride in emulsion (a) | 0.23 |
| Gelatin | 1.04 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th layer (ultraviolet absorbing layer) | |
| Gelatin | 0.48 |
| Ultraviolet absorbent (UV-1) | 0.16 |
| Color mixing inhibitor (Cpd-5) | 0.02 |
| Solvent (Solv-5) | 0.08 |
| 7th layer (protective layer) | |
| Gelatin | 1.10 |
| Acryl-modifiled copolymer of polyvinyl alcohol (modification degree: 17%) | 0.17 |
| Liquid paraffin | 0.03 |

The chemical structures of the compounds incorporated in these layers are the same as those having the same symbol and used in Example 1.

Semiconductor lasers AlGaInP (oscillation wavelength: about 670 hm), GaAlAs (oscillation wavelength: about 750 nm), and GaAlAs (oscillation wavelength: about 830 nm) were used. These lasers were adapted to provide a sequential scanning exposure on a color photographic paper moving vertically with respect to the scanning direction from rotary polyhedrons. Using this apparatus, the amount of light was altered to determine the relationship (D−log E) between the density (D) of the light-sensitive material and the incident amount of light (E). The exposure amount from the semiconductor lasers was controlled by a combination of a pulse width modulation system in which the time of conduction to the semiconductor lasers is altered to modulate the amount of light and an intensity modulation system in which the amount of conduction is altered to modulate the amount of the light. The scanning exposure was effected at 400 dpi. The average exposure time per pixel was about $10^{-7}$ second.

The other processing conditions were the same as in Example 1. The photographic materials thus exposed and processed were also evaluated as in Example 1. Using the apparatus of Example 1 equipped with check valves for the reverse osmotic membrane device, little or no increase wa observed in the minimum yellow density with time (within 0.02). Furthermore, no leakage of the processing solution to the periphery of the processing machine was observed. Thus, it was determined that the effect of the present invention are also obtained for processing laser scanned photographic materials.

EXAMPLE 4

Instead of the processing machine shown in FIG. 1 as used in Example 1, processing machines equipped with the processing baths shown in FIGS. 3 and 4 were used. In the processing machine equipped with the processing bath shown in FIG. 3, the processing solution drawing rollers designated by the reference numeral 50 had a rotation speed of 1,000 rpm and a diameter of 6 cm, 5 cm, 4 cm, 4 cm and 4 cm, respectively, in the downstream direction of the photographic material. The surface of these rollers had a 2-mm pitch spiral inclined 10° with respect to the direction of the conveyance of the light-sensitive material. The conveying speed of the light-sensitive material was 4.2 m/min. In the processing machine equipped with the processing bath shown in FIG. 4, the processing solution drawing rollers designated by the reference numeral 54 had a rotation speed of 500 rpm and a diameter of 6 cm. The surface of these rollers had a 2-mm pitch spiral inclined 10° with respect to the direction of the conveyance of the light-sensitive material. The conveying speed of the light-sensitive material was 4.2 m/min. The light-sensitive material and other processing conditions used were the same as in Example 1. The use of this apparatus equipped with passage shut-off means for preventing the processing solution from flowing out from the reverse osmotic membrane apparatus resulted in little or no increase in the minimum yellow density (within 0.02) with time. Further, there was no leakage of the processing solution to the periphery of the processing machine. Thus, the effects of the present invention were also obtained using the embodiments f FIGS. 3 and 4.

While the invention has been described in detail and with reference to specific embodiments thereof, it will be apparent to one skilled in the art that various changes and modifications can be made therein without departing from the spirit and scope thereof.

What is claimed is:

1. A wet photographic processing apparatus adapted for processing an imagewise exposed silver halide photographic material comprising a support having thereon at least one light-sensitive silver halide emulsion layer, said processing comprising at least a developing step followed by at least one of a washing step and a stabilizing step, said apparatus comprising:

(i) a developing bath;

(ii) at least one of a plurality of washing baths in countercurrent cascade connection and/or a plurality of stabilizing baths in countercurrent cascade connection;

(iii) means for filtering at least a portion of a washing and/or stabilizing solution drawn from an upstream bath among said plurality of baths, said filtering means including a reverse osmotic membrane apparatus and a pipe connecting the upstream bath and the reverse osmotic membrane apparatus, said reverse osmotic membrane apparatus filtering said washing or stabilizing solution to produce a filtrate;

(iv) means for introducing the filtrate from said reverse osmotic membrane apparatus into a downstream bath among said plurality of baths; and (v) means, provided in said pipe, for automatically shutting-off fluid flow between said upstream bath and said reverse osmotic membrane apparatus concurrent with suspension of processing.

2. The processing apparatus of claim 1, wherein the capacity of at least one of the washing baths and stabilizing baths is 10 l or less.

3. The processing apparatus of claim 1, further comprising means for countercurrent replenishment of the washing baths and/or stabilizing baths in an amount of 150 ml or less per $m^2$ of photographic material processed, and further comprising means for controlling the volume ratio of the filtrate rate to replenishment rate per unit time of from 5 to 55.

4. The processing apparatus of claim 1, further comprising means for pumping provided in the pipe connecting the upstream bath and the reverse osmotic membrane apparatus.

5. The processing aparatus of claim 1, wherein the ratio of the internal capacity of the upstream bath to the total internal capacity of the reverse osmotic membrane apparatus is in the range of from 0.1 to 10.

6. The processing apparatus of claim 1, wherein the number of washing baths or stabilizing baths is from 2 to 6.

7. The processing apparatus of claim 3, wherein the ratio of the total internal capacity of the reverse osmotic membrane apparatus (ml) to the replenishment rate ($ml/m^2$) is in the range of from 3 to 500.

8. The processing apparatus of claim 3, wherein the replenishment rate is in the range of from 30 to 150 $ml/m^2$.

9. The processing apparatus of claim 4, wherein the washing and/or stabilizing solution drawn from the upstream bath is pumped to the reverse osmotic membrane apparatus at a liquid pumping pressure of from 2 to 15 $kg/cm^2$.

10. The processing apparatus of claim 1, wherein said shutting-off means comprises a check valve.

11. The processing apparatus of claim 1, further comprising control means for shutting-off fluid flow between the upstream bath and the reverse osmotic membrane apparatus when operation of the processing apparatus is suspended.

12. The processing apparatus of claim 1, further comprising means for shutting-off fluid flow between the reverse osmotic membrane apparatus and the downstream bath.

13. The processing apparatus of claim 1, wherein the internal capacity of the reverse osmotic membrane apparatus is in the range of from 300 ml to 10 l.

14. The processing apparatus of claim 1, further comprising means for introducing concentrated solution produced in the reverse osmotic membrane apparatus into said upstream bath.

15. The processing apparatus of claim 14, wherein said means for introducing concentrated solution into the upstream further comprises means for shutting-off fluid flow between said upstream bath and the reverse osmotic membrane apparatus.

16. The processing apparatus of claim 1, wherein said means for introducing the filtrate from said reverse osmotic membrane apparatus into the downstream bath has further means for shutting-off fluid flow between the reverse osmotic membrane apparatus and the downstream bath.

17. The processing apparatus of claim 1, wherein the capacity of at least one of the washing baths and stabilizing baths is 4 l or less.

18. A wet photographic processing apparatus adapted for processing an imagewise exposed silver halide photographic material comprising a support having thereon at least one light-sensitive silver halide emulsion layer, said processing comprising at least a developing step followed by at least one of a washing step and a stabilizing step, said apparatus comprising:

(i) a developing bath;

(ii) at least one of a plurality of washing baths in countercurrent cascade connection and/or a plurality of stabilizing baths in countercurrent cascade connection;

(iii) means for filtering at least a portion of a washing and/or stabilizing solution drawn from an upstream bath among said plurality of baths, said filtering means including a reverse osmotic membrane apparatus and a pipe connecting the upstream bath and the reverse osmotic membrane apparatus, said reverse osmotic membrane apparatus filtering said washing or stabilizing solution to produce a filtrate;

(iv) means for introducing the filtrate from said reverse osmotic membrane apparatus into a downstream bath among said plurality of baths; and (v) means, provided in said pipe, for automatically shutting-off fluid flow between said upstream bath and said reverse osmotic membrane apparatus concurrent with suspension of processing, wherein the internal capacity of the reverse osmotic membrane apparatus is in the range of from 300 ml to 10 l, and the capacity of at least one of the washing baths and stabilizing baths is 4 l or less.

19. A wet photographic processing apparatus adapted for processing an imagewise exposed silver halide photographic material comprising a support having thereon at least one light-sensitive silver halide emulsion layer, said processing comprising at least a developing step followed by at least one of a washing step and a stabilizing step, said apparatus comprising:

(i) a developing bath;

(ii) at least one of a plurality of washing baths in countercurrent cascade connection and/or a plurality of stabilizing baths in countercurrent cascade connection;

(iii) means for filtering at least a portion of a washing and/or stabilizing solution drawn from an upstream bath among said plurality of baths, said filtering means including a reverse osmotic membrane apparatus and a pipe connecting the upstream bath and the reverse osmotic membrane apparatus, said reverse osmotic membrane apparatus filtering said washing or stabilizing solution to produce a filtrate;

(iv) means for introducing the filtrate from said reverse osmotic membrane apparatus into a downstream bath among said plurality of baths; and (v) means, provided in said pipe, for shutting-off fluid flow between said upstream bath and said reverse osmotic membrane apparatus, wherein at least one processing bath is interposed between the upstream bath and the downstream bath.

* * * * *